US009652921B2

(12) United States Patent
MacKay et al.

(10) Patent No.: US 9,652,921 B2
(45) Date of Patent: May 16, 2017

(54) COIN CHUTE WITH ANTI-FISHING ASSEMBLY

(71) Applicant: J.J. MACKAY CANADA LIMITED, New Glasgow (CA)

(72) Inventors: George Allan MacKay, New Glasgow (CA); Darren Scott Cameron, New Glasgow (CA); Donald Stacy Sinclair, Coquitlam (CA)

(73) Assignee: J.J. MACKAY CANADA LIMITED (CA)

( * ) Notice: Subject to any disclaimer, the term of this patent is extended or adjusted under 35 U.S.C. 154(b) by 0 days.

(21) Appl. No.: 14/743,691

(22) Filed: Jun. 18, 2015

(65) Prior Publication Data

US 2016/0371915 A1 Dec. 22, 2016

(30) Foreign Application Priority Data

Jun. 16, 2015 (CA) ..... 2894350

(51) Int. Cl.
*G07F 1/04* (2006.01)
*G07F 17/24* (2006.01)
*G07F 11/00* (2006.01)

(52) U.S. Cl.
CPC ..... *G07F 1/042* (2013.01); *G07F 11/00* (2013.01); *G07F 17/24* (2013.01); *G07F 1/04* (2013.01)

(58) Field of Classification Search
CPC G07D 11/0003; G07D 11/0018; G07F 1/041; G07F 1/042; G07F 1/043; G07F 17/248
USPC ..... 194/202, 203; 193/DIG. 1; 232/55, 57, 232/58, 59, 63
See application file for complete search history.

(56) References Cited

U.S. PATENT DOCUMENTS

| | | | | |
|---|---|---|---|---|
| 480,108 | A | 8/1892 | Loch | 232/62 |
| 1,189,991 | A | 7/1916 | Mugler | 70/120 |
| 1,445,771 | A | 2/1923 | Keplinger | |
| 1,818,568 | A | 8/1931 | Melick | 194/203 |
| D98,810 | S | 3/1936 | Magee | |
| D100,875 | S | 8/1936 | Michaels | |
| D101,237 | S | 9/1936 | Miller | |

(Continued)

FOREIGN PATENT DOCUMENTS

| | | | |
|---|---|---|---|
| AU | 4035701 | 9/2001 | G07F 17/24 |
| AU | 200227724 | 1/2003 | G07C 1/30 |

(Continued)

OTHER PUBLICATIONS

US 8,636,133, 01/2014, MacKay et al. (withdrawn)

(Continued)

*Primary Examiner* — Mark Beauchaine
(74) *Attorney, Agent, or Firm* — Hayes Soloway P.C.

(57) ABSTRACT

A coin chute for a vending machine may include one or more anti-fishing assemblies located in the vicinity of the coin chute's opening for receiving coins. The anti-fishing assemblies may include one or more rotatable anti-fishing fingers that project into a coin channel. The anti-fling fingers may rotate out of the coin channel to allow inserted coins to pass. In addition, the anti-fishing fingers prevent withdrawal of inserted coins out of the coin channel. The anti-fishing assemblies may be in addition to anti-pull back assemblies that prevent inserted coins from being withdrawn back past a coin discriminator.

34 Claims, 8 Drawing Sheets

(56) References Cited

U.S. PATENT DOCUMENTS

| | | | | |
|---|---|---|---|---|
| D107,577 | S | 12/1937 | McGay | D10/42 |
| 2,118,318 | A | 5/1938 | Magee | 194/84 |
| D112,677 | S | 12/1938 | Broussard et al. | |
| 2,161,046 | A | 6/1939 | Hitzeman | 194/205 |
| D116,805 | S | 9/1939 | Reznek | |
| 2,229,183 | A | 1/1941 | Mitchell | 194/277 |
| 2,261,353 | A | 11/1941 | Gaetano | 70/120 |
| 2,289,838 | A | 7/1942 | Herschede et al. | 194/226 |
| D152,294 | S | 1/1949 | Siegel et al. | D20/10 |
| D152,587 | S | 2/1949 | Brundage | D52/3 |
| D154,716 | S | 8/1949 | Simpson | D10/42 |
| 2,483,805 | A | 10/1949 | Broussard et al. | 232/1 |
| 2,495,784 | A | 1/1950 | Starts | |
| D162,698 | S | 3/1951 | Teague | D52/3 |
| 2,546,433 | A | 3/1951 | Dick | 368/6 |
| 2,547,272 | A | 4/1951 | Lawson et al. | 116/282 |
| 2,550,433 | A | 4/1951 | Tichenor | 224/1 |
| D166,059 | S | 2/1952 | Yoss | D10/42 |
| 2,594,388 | A | 4/1952 | Broussard | 194/1 |
| 2,595,124 | A | 4/1952 | Campbell | 250/27 |
| D166,753 | S | 5/1952 | Jones | D10/42 |
| 2,596,122 | A | 5/1952 | Broussard | 194/101 |
| 2,596,123 | A | 5/1952 | Broussard | 194/1 |
| 2,596,124 | A | 5/1952 | Broussard | 368/90 |
| 2,599,881 | A | 6/1952 | Woodruff | 368/92 |
| 2,613,792 | A | 10/1952 | Broussard | 194/72 |
| 2,613,871 | A | 10/1952 | Broussard et al. | 232/16 |
| 2,618,371 | A | 11/1952 | Broussard | 194/84 |
| 2,633,960 | A | 4/1953 | Broussard | 194/72 |
| D181,359 | S | 11/1957 | Jones | D10/42 |
| 2,818,371 | A | 12/1957 | Wessinger | 167/93 |
| 2,822,682 | A | 2/1958 | Sollenberger | 70/158 |
| 2,832,506 | A | 4/1958 | Hatcher | 221/103 |
| D189,106 | S | 10/1960 | Leiderman | D52/3 |
| 2,985,978 | A | 5/1961 | Breen et al. | 40/333 |
| 2,988,191 | A | 6/1961 | Grant | 194/1 |
| 2,995,230 | A | 8/1961 | Moody et al. | 194/9 |
| 3,018,615 | A | 1/1962 | Minton et al. | 368/7 |
| 2,956,525 | A | 10/1962 | Blauvelt | 109/59 |
| 3,056,544 | A | 10/1962 | Sollenberger et al. | 232/16 |
| D199,270 | S | 9/1964 | Michaels | D52/3 |
| D200,216 | S | 2/1965 | Broussard | D52/3 |
| 3,183,411 | A | 5/1965 | Palfi | 317/123 |
| 3,199,321 | A | 8/1965 | Sollenberger | 70/1.5 |
| 3,204,438 | A | 9/1965 | Sollenberger | 70/417 |
| 3,208,061 | A | 9/1965 | Gervasi et al. | 340/539.31 |
| 3,262,540 | A | 7/1966 | Sollenberger et al. | 194/72 |
| 3,272,299 | A | 9/1966 | Sollenberger | 194/2 |
| 3,324,647 | A | 6/1967 | Jedynak | 368/6 |
| 3,373,856 | A | 3/1968 | Kusters et al. | 194/100 |
| 3,438,031 | A | 4/1969 | Fathauer | 343/8 |
| 3,486,324 | A | 12/1969 | Andersson | 368/90 |
| 3,519,113 | A | 7/1970 | Arzig et al. | 194/2 |
| 3,535,870 | A | 10/1970 | Mitchell | 58/142 |
| 3,565,283 | A | 2/1971 | Sciacero et al. | 221/197 |
| 3,637,277 | A | 1/1972 | Krug et al. | 312/217 |
| 3,666,067 | A | 5/1972 | Kaiser | 194/225 |
| 3,721,463 | A | 3/1973 | Attwood et al. | 287/20.3 |
| 3,941,989 | A | 3/1976 | McLaughlin et al. | 235/156 |
| 3,975,934 | A | 8/1976 | Babai et al. | 70/120 |
| 3,982,620 | A | 9/1976 | Kortenhaus | 194/1 N |
| 3,991,595 | A | 11/1976 | Bahry et al. | 70/120 |
| 3,999,372 | A | 12/1976 | Welch et al. | 58/142 |
| 4,031,991 | A | 6/1977 | Malott | 194/1 R |
| 4,043,117 | A | 8/1977 | Maresca et al. | 58/142 |
| 4,237,710 | A | 12/1980 | Cardozo | 70/108 |
| 4,248,336 | A | 2/1981 | Fiedler | 194/97 |
| 4,249,648 | A | 2/1981 | Meyer | 194/102 |
| 4,264,963 | A | 4/1981 | Leach | 364/707 |
| 4,306,219 | A | 12/1981 | Main et al. | 340/825.54 |
| 4,317,180 | A | 2/1982 | Lies | 364/707 |
| 4,317,181 | A | 2/1982 | Teza et al. | 364/707 |
| 4,323,847 | A | 4/1982 | Karbowski | 324/327 |
| 4,379,334 | A | 4/1983 | Feagins, Jr. et al. | 364/467 |
| 4,409,665 | A | 10/1983 | Tubbs | 364/707 |
| 4,432,447 | A | 2/1984 | Tanaka | 194/100 |
| 4,460,080 | A | 7/1984 | Howard | 194/100 A |
| 4,474,281 | A | 10/1984 | Roberts et al. | 194/1 N |
| 4,479,191 | A | 10/1984 | Nojima et al. | 364/707 |
| 4,483,431 | A | 11/1984 | Pratt | 194/97 |
| D278,689 | S | 5/1985 | Jupe | D10/42 |
| 4,574,936 | A | 3/1986 | Klinger | 194/318 |
| 4,639,021 | A | 1/1987 | Hope | 292/7 |
| 4,678,994 | A | 7/1987 | Davies | 324/236 |
| 4,742,903 | A | 5/1988 | Trummer | 194/317 |
| 4,749,074 | A | 6/1988 | Ueki et al. | 194/317 |
| D296,795 | S | 7/1988 | Bouve | D20/10 |
| 4,763,769 | A | 8/1988 | Levasseur | 194/217 |
| 4,809,838 | A | 3/1989 | Houserman | 194/317 |
| 4,812,805 | A | 3/1989 | Lachat et al. | 340/825.05 |
| 4,823,928 | A | 4/1989 | Speas | |
| 4,825,425 | A | 4/1989 | Turner | 368/7 |
| 4,827,206 | A | 5/1989 | Speas | 323/299 |
| 4,845,484 | A | 7/1989 | Ellsberg | 340/825.35 |
| 4,848,556 | A | 7/1989 | Shah et al. | 194/212 |
| 4,851,987 | A | 7/1989 | Day | 364/200 |
| 4,872,149 | A | 10/1989 | Speas | 368/90 |
| 4,875,598 | A | 10/1989 | Dahl | 221/4 |
| 4,880,097 | A | 11/1989 | Speas | 194/239 |
| 4,880,406 | A | 11/1989 | Van Horn et al. | 464/38 |
| 4,895,238 | A | 1/1990 | Speas | 194/319 |
| 4,951,799 | A | 8/1990 | Xai | 194/317 |
| 4,967,895 | A | 11/1990 | Speas | 194/200 |
| 4,976,630 | A | 12/1990 | Schuder et al. | 439/260 |
| 4,989,714 | A | 2/1991 | Abe | 194/317 |
| 5,027,935 | A | 7/1991 | Berg et al. | 194/318 |
| D319,077 | S | 8/1991 | Arato et al. | D20/6 |
| 5,060,777 | A | 10/1991 | Van Horn et al. | 194/317 |
| 5,065,156 | A | 11/1991 | Bernier | 340/932.2 |
| 5,076,414 | A | 12/1991 | Kimoto | 194/317 |
| 5,088,073 | A | 2/1992 | Speas | 368/90 |
| 5,109,972 | A | 5/1992 | Van Horn et al. | 194/217 |
| 5,119,916 | A | 6/1992 | Carmen et al. | 194/210 |
| 5,155,614 | A | 10/1992 | Carmen et al. | 398/202 |
| 5,158,166 | A | 10/1992 | Barson | 194/319 |
| 5,184,707 | A | 2/1993 | Van Horn et al. | 194/204 |
| 5,192,855 | A | 3/1993 | Insulander et al. | 235/381 |
| D336,860 | S | 6/1993 | Clough | D10/42 |
| 5,222,076 | A | 6/1993 | Ng et al. | 375/9 |
| 5,244,070 | A | 9/1993 | Carmen et al. | 194/319 |
| D340,038 | S | 10/1993 | Venne et al. | D14/420 |
| 5,259,491 | A | 11/1993 | Ward, II | 194/350 |
| 5,266,947 | A | 11/1993 | Fujiwara et al. | 340/932.2 |
| D342,209 | S | 12/1993 | Clough | D10/42 |
| 5,273,151 | A | 12/1993 | Carmen et al. | 194/319 |
| 5,287,384 | A | 2/1994 | Avery et al. | 375/1 |
| 5,293,979 | A | 3/1994 | Levasseur | 194/317 |
| 5,298,894 | A | 3/1994 | Cerny et al. | 340/870.02 |
| 5,343,237 | A | 8/1994 | Morimoto | 348/143 |
| D351,193 | S | 10/1994 | Abe | D20/9 |
| 5,351,798 | A | 10/1994 | Hayes | 194/318 |
| 5,360,095 | A | 11/1994 | Speas | 194/217 |
| D354,835 | S | 1/1995 | Brendel | D99/43 |
| 5,382,780 | A | 1/1995 | Carmen | 235/384 |
| 5,402,475 | A | 3/1995 | Lesner, Jr. et al. | 379/106 |
| 5,407,049 | A | 4/1995 | Jacobs | 194/200 |
| D360,734 | S | 7/1995 | Hall | D99/28 |
| 5,439,089 | A | 8/1995 | Parker | 194/317 |
| 5,442,348 | A | 8/1995 | Mushell | 340/932.2 |
| 5,454,461 | A | 10/1995 | Jacobs | 194/200 |
| 5,471,139 | A | 11/1995 | Zadoff | 324/244.1 |
| 5,475,373 | A | 12/1995 | Speas | 340/815.58 |
| 5,489,014 | A | 2/1996 | Menoud | 194/211 |
| 5,500,517 | A | 3/1996 | Cagliostro | 235/486 |
| 5,526,662 | A | 6/1996 | Diekhoff et al. | 70/278 |
| 5,563,491 | A | 10/1996 | Tseng | 320/2 |
| 5,568,441 | A | 10/1996 | Sanemitsu | 365/229 |
| D375,607 | S | 11/1996 | Hall | D99/28 |
| 5,570,771 | A | 11/1996 | Jacobs | 194/200 |
| 5,614,892 | A | 3/1997 | Ward, II et al. | 340/870.02 |
| 5,617,942 | A | 4/1997 | Ward, II et al. | 194/217 |
| 5,640,002 | A | 6/1997 | Ruppert et al. | 235/472 |
| 5,642,119 | A | 6/1997 | Jacobs | 342/69 |
| 5,648,906 | A | 7/1997 | Amirpanahi | 705/418 |

(56) References Cited

U.S. PATENT DOCUMENTS

| | | | | |
|---|---|---|---|---|
| D381,976 | S | 8/1997 | Sandor et al. | D14/420 |
| 5,659,306 | A | 8/1997 | Bahar | 340/932.2 |
| 5,687,129 | A | 11/1997 | Kim | 365/229 |
| D388,231 | S | 12/1997 | Magee et al. | D99/28 |
| 5,710,743 | A | 1/1998 | Dee et al. | 368/90 |
| D391,238 | S | 2/1998 | Sakata | D14/420 |
| 5,732,812 | A | 3/1998 | Grainger et al. | 194/217 |
| D393,212 | S | 4/1998 | Lucas | D10/42 |
| 5,737,710 | A | 4/1998 | Anthonyson | 701/1 |
| 5,740,050 | A | 4/1998 | Ward, II | 364/464.28 |
| 5,748,103 | A | 5/1998 | Flach et al. | 340/870.07 |
| D395,133 | S | 6/1998 | Mikami et al. | D99/43 |
| 5,761,061 | A | 6/1998 | Amano | 364/187 |
| 5,777,302 | A * | 7/1998 | Nakagawa | G07F 1/02 194/344 |
| 5,777,951 | A | 7/1998 | Mitschele et al. | 368/90 |
| 5,778,067 | A | 7/1998 | Jones et al. | 380/24 |
| D396,655 | S | 8/1998 | Anderson | D10/42 |
| 5,803,228 | A | 9/1998 | Lucas | 194/350 |
| 5,805,083 | A | 9/1998 | Sutton et al. | 340/932.2 |
| 5,806,651 | A | 9/1998 | Carmen et al. | 194/319 |
| D400,115 | S | 10/1998 | Yaron et al. | D10/104 |
| 5,833,042 | A | 11/1998 | Baitch et al. | 194/317 |
| 5,841,369 | A | 11/1998 | Sutton et al. | 340/932.2 |
| 5,842,411 | A | 12/1998 | Johnson | 101/36 |
| 5,845,268 | A | 12/1998 | Moore | 705/418 |
| 5,852,411 | A | 12/1998 | Jacobs et al. | 340/932.2 |
| D404,025 | S | 1/1999 | Van Horne et al. | D14/331 |
| 5,903,520 | A | 5/1999 | Dee et al. | 368/90 |
| 5,906,260 | A * | 5/1999 | Goodrich | G07F 1/043 194/203 |
| 5,911,763 | A | 6/1999 | Quesada | 70/120 |
| D411,848 | S | 7/1999 | Maruska et al. | D16/202 |
| D412,289 | S | 7/1999 | Winwood | D10/42 |
| D413,311 | S | 8/1999 | Blalock | D14/420 |
| 5,940,481 | A | 8/1999 | Zietman | 379/114 |
| 5,954,182 | A | 9/1999 | Wei | 194/345 |
| 5,966,345 | A | 10/1999 | Dee et al. | 368/90 |
| 6,026,946 | A | 2/2000 | McCarty, Jr. | 194/317 |
| 6,037,880 | A | 3/2000 | Manion | 340/932.2 |
| 6,052,453 | A | 4/2000 | Sagady et al. | 379/146 |
| 6,078,272 | A | 6/2000 | Jacobs et al. | 340/932.2 |
| 6,081,205 | A | 6/2000 | Williams | 340/932.2 |
| 6,081,206 | A | 6/2000 | Kielland | 340/937 |
| 6,082,153 | A | 7/2000 | Schoell et al. | 70/1.5 |
| 6,098,361 | A | 8/2000 | Roten et al. | 52/298 |
| 6,107,942 | A | 8/2000 | Yoo et al. | 340/932.2 |
| 6,109,418 | A | 8/2000 | Yost | 194/350 |
| 6,111,522 | A | 8/2000 | Hiltz et al. | 340/932.2 |
| 6,116,403 | A | 9/2000 | Kiehl | 194/217 |
| D431,788 | S | 10/2000 | Tuxen et al. | D10/42 |
| 6,147,624 | A | 11/2000 | Clapper | 340/932.2 |
| 6,193,045 | B1 * | 2/2001 | Ishida | G07F 1/043 194/203 |
| 6,195,015 | B1 | 2/2001 | Jacobs et al. | 340/693.9 |
| D439,591 | S | 3/2001 | Reidt et al. | D16/208 |
| RE37,193 | E | 5/2001 | Ward et al. | 194/217 |
| 6,229,455 | B1 | 5/2001 | Yost et al. | 340/943 |
| 6,230,868 | B1 | 5/2001 | Tuxen et al. | 194/217 |
| 6,243,028 | B1 | 6/2001 | Krygler et al. | 340/932.2 |
| 6,243,029 | B1 | 6/2001 | Tomer | 340/932.2 |
| 6,275,169 | B1 | 8/2001 | Krygler et al. | 340/932.2 |
| 6,275,170 | B1 | 8/2001 | Jacobs et al. | 340/932.2 |
| D447,714 | S | 9/2001 | Cappiello | D10/104 |
| D448,910 | S | 10/2001 | Kit et al. | D99/28 |
| D449,010 | S | 10/2001 | Petrucelli | D10/109 |
| 6,309,098 | B1 | 10/2001 | Wong | 368/94 |
| D450,253 | S | 11/2001 | Marguet | D10/42 |
| 6,312,152 | B2 | 11/2001 | Dee et al. | 368/90 |
| 6,321,201 | B1 | 11/2001 | Dahl | 705/1 |
| RE37,531 | E | 1/2002 | Chaco et al. | 379/38 |
| 6,340,935 | B1 | 1/2002 | Hall | 340/932.2 |
| D454,421 | S | 3/2002 | Jeon et al. | D99/28 |
| D454,807 | S | 3/2002 | Cappiello | D10/109 |
| 6,354,425 | B1 | 3/2002 | Tuxen et al. | 194/350 |
| 6,366,220 | B1 | 4/2002 | Elliott | 340/928 |
| 6,373,422 | B1 | 4/2002 | Mostafa | 341/155 |
| 6,373,442 | B1 | 4/2002 | Thomas et al. | 343/767 |
| D460,005 | S | 7/2002 | Jacquet | D10/42 |
| D461,728 | S | 8/2002 | Tuxen et al. | D10/42 |
| 6,456,491 | B1 | 9/2002 | Flannery et al. | 361/685 |
| D463,749 | S | 10/2002 | Petrucelli | D10/109 |
| 6,457,586 | B2 | 10/2002 | Yasuda et al. | 209/534 |
| 6,467,602 | B2 | 10/2002 | Bench et al. | 194/217 |
| 6,477,875 | B2 | 11/2002 | Field et al. | 70/491 |
| D467,954 | S | 12/2002 | Suzuki et al. | D16/208 |
| 6,493,676 | B1 | 12/2002 | Levy | 705/13 |
| 6,505,774 | B1 | 1/2003 | Fulcher et al. | |
| D471,238 | S | 3/2003 | Showers et al. | D20/8 |
| D472,362 | S | 3/2003 | Zerman et al. | D99/28 |
| 6,575,281 | B2 | 6/2003 | Lee | 192/49 |
| D477,030 | S | 7/2003 | Kolls et al. | D20/8 |
| D481,516 | S | 10/2003 | Magee et al. | D99/28 |
| D485,417 | S | 1/2004 | Magee et al. | D99/28 |
| 6,697,730 | B2 | 2/2004 | Dickerson | 701/200 |
| D488,280 | S | 4/2004 | Zerman et al. | D99/28 |
| D492,080 | S | 6/2004 | Magee et al. | D99/28 |
| D492,081 | S | 6/2004 | Magee et al. | D99/28 |
| 6,747,575 | B2 | 6/2004 | Chauvin et al. | 340/932.2 |
| D494,730 | S | 8/2004 | Magee et al. | D99/28 |
| 6,791,473 | B2 | 9/2004 | Kibria et al. | 340/932.2 |
| RE38,626 | E | 10/2004 | Kielland | 340/937 |
| D497,393 | S | 10/2004 | Herbst | D20/99 |
| 6,799,387 | B2 | 10/2004 | Pippins | 37/456 |
| D497,814 | S | 11/2004 | Odinotski et al. | D10/42 |
| D498,795 | S | 11/2004 | Nunn | D20/8 |
| 6,823,317 | B1 | 11/2004 | Ouimet et al. | 705/13 |
| 6,856,922 | B1 | 2/2005 | Austin et al. | 702/63 |
| 6,874,340 | B1 | 4/2005 | Berman | 7/161 |
| D505,240 | S | 5/2005 | Swaine et al. | D99/28 |
| 6,889,899 | B2 | 5/2005 | Silberberg | 235/384 |
| D506,509 | S | 6/2005 | Nunn | D20/9 |
| D506,769 | S | 6/2005 | Asai | D16/203 |
| 6,914,411 | B2 | 7/2005 | Couch et al. | 320/101 |
| D508,064 | S | 8/2005 | Ramirez | D16/200 |
| 6,929,179 | B2 | 8/2005 | Fulcher et al. | 235/381 |
| D510,751 | S | 10/2005 | Magee et al. | D20/3 |
| 7,004,385 | B1 | 2/2006 | Douglass | 235/379 |
| 7,014,355 | B2 | 3/2006 | Potter, Sr. et al. | 368/90 |
| 7,019,420 | B2 | 3/2006 | Kogan et al. | 307/150 |
| 7,019,670 | B2 | 3/2006 | Bahar | 340/932.2 |
| 7,027,773 | B1 | 4/2006 | McMillin | 455/41.2 |
| 7,028,888 | B2 | 4/2006 | Laskowski | 235/379 |
| 7,029,167 | B1 | 4/2006 | Mitschele | 368/90 |
| 7,040,534 | B2 | 5/2006 | Turocy et al. | 235/379 |
| D524,834 | S | 7/2006 | Dozier et al. | D16/200 |
| 7,071,839 | B2 | 7/2006 | Patel et al. | 340/933 |
| 7,104,447 | B1 | 9/2006 | Lopez et al. | 235/384 |
| 7,114,651 | B2 | 10/2006 | Hjelmvik | 235/384 |
| 7,181,426 | B2 | 2/2007 | Dutta | 705/37 |
| 7,183,999 | B2 | 2/2007 | Matthews et al. | 345/1.1 |
| D538,505 | S | 3/2007 | Kang et al. | D99/28 |
| D543,588 | S | 5/2007 | Herbert et al. | D20/8 |
| 7,222,031 | B2 | 5/2007 | Heatley | |
| 7,222,782 | B2 | 5/2007 | Lute, Jr. et al. | 235/379 |
| 7,237,176 | B2 | 6/2007 | Briggs et al. | 714/67 |
| D546,365 | S | 7/2007 | Jost et al. | D16/221 |
| 7,237,716 | B2 | 7/2007 | Silberberg | 235/384 |
| 7,253,747 | B2 | 8/2007 | Noguchi | 340/932.2 |
| 7,284,692 | B1 | 10/2007 | Douglass | 235/379 |
| 7,319,974 | B1 | 1/2008 | Brusseaux | 705/13 |
| 7,330,131 | B2 | 2/2008 | Zanotti et al. | 340/932.2 |
| D570,920 | S | 6/2008 | Choi | D20/2 |
| 7,382,238 | B2 | 6/2008 | Kavaler | 340/438 |
| 7,382,281 | B2 | 6/2008 | Kavaler | 340/941 |
| 7,382,282 | B2 | 6/2008 | Kavaler | 340/941 |
| 7,388,349 | B2 | 6/2008 | Elder et al. | 320/104 |
| 7,388,517 | B2 | 6/2008 | Kavaler | 340/941 |
| 7,393,134 | B2 | 7/2008 | Mitschele | 368/90 |
| D575,168 | S | 8/2008 | King et al. | D10/42 |
| 7,419,091 | B1 | 9/2008 | Scanlon | 235/379 |
| 7,427,931 | B1 | 9/2008 | Kavaler et al. | 340/941 |
| D579,795 | S | 11/2008 | Martinez et al. | D10/42 |
| 7,445,144 | B2 | 11/2008 | Schlabach et al. | 235/379 |

(56) References Cited

U.S. PATENT DOCUMENTS

| | | | | |
|---|---|---|---|---|
| D582,125 | S | 12/2008 | Kang et al. | D99/28 |
| D587,141 | S | 2/2009 | King et al. | D10/42 |
| 7,533,802 | B1 | 5/2009 | McGinley et al. | 235/379 |
| D596,374 | S | 7/2009 | Kang et al. | D99/28 |
| 7,594,235 | B2 | 9/2009 | Moreau | 719/310 |
| D602,225 | S | 10/2009 | Lute et al. | D99/28 |
| 7,617,120 | B2 | 11/2009 | Derasmo et al. | 705/13 |
| D605,145 | S | 12/2009 | Kellar | D14/125 |
| 7,624,919 | B2 | 12/2009 | Meek et al. | 235/379 |
| 7,699,224 | B2 | 4/2010 | Molé | 235/439 |
| D615,274 | S | 5/2010 | Kim et al. | D99/28 |
| D617,799 | S | 6/2010 | Odhe et al. | D14/420 |
| 7,739,000 | B2 | 6/2010 | Kevaler | 701/1 |
| 7,748,620 | B2 | 7/2010 | Gomez et al. | 235/383 |
| 7,772,720 | B2 | 8/2010 | McGee et al. | 307/66 |
| 7,780,072 | B1 | 8/2010 | Lute et al. | 235/379 |
| D625,305 | S | 10/2010 | Bleck et al. | D14/307 |
| 7,806,248 | B2 | 10/2010 | Hunter et al. | 194/317 |
| D627,814 | S | 11/2010 | Tzeng et al. | D16/202 |
| 7,825,826 | B2 | 11/2010 | Welch | 340/932.2 |
| 7,854,310 | B2 | 12/2010 | King et al. | 194/350 |
| 7,855,661 | B2 | 12/2010 | Ponert | 340/932.2 |
| 7,874,482 | B2 | 1/2011 | Mitschele | 235/384 |
| D632,740 | S | 2/2011 | Adeline | D20/2 |
| 7,933,841 | B2 | 4/2011 | Schmeyer et al. | 705/64 |
| D645,223 | S | 9/2011 | Bleck et al. | D99/28 |
| 8,035,533 | B2 | 10/2011 | Kavaler | 340/933 |
| D652,329 | S | 1/2012 | MacKay et al. | D10/42 |
| D652,872 | S | 1/2012 | Mougin et al. | D20/1 |
| D653,014 | S | 1/2012 | Rohan et al. | D99/28 |
| D653,420 | S | 1/2012 | Rohan et al. | D99/28 |
| D653,421 | S | 1/2012 | Rohan et al. | D99/28 |
| D653,424 | S | 1/2012 | Rohan et al. | D99/28 |
| D654,816 | S | 2/2012 | MacKay et al. | D10/42 |
| RE43,245 | E | 3/2012 | Ouimet et al. | 705/13 |
| D655,263 | S | 3/2012 | Tsai | D14/125 |
| D656,046 | S | 3/2012 | MacKay et al. | D10/42 |
| 8,138,950 | B1 | 3/2012 | Leung | 340/932.2 |
| 8,144,034 | B2 | 3/2012 | Kavaler | 340/941 |
| D659,557 | S | 5/2012 | Jones et al. | D10/42 |
| 8,184,019 | B2 | 5/2012 | Chauvin et al. | 340/932.2 |
| D661,603 | S | 6/2012 | MacKay et al. | D10/42 |
| 8,193,540 | B2 | 6/2012 | Huang et al. | 257/81 |
| 8,232,894 | B2 | 7/2012 | Weiss et al. | 340/932.2 |
| 8,264,401 | B1 | 9/2012 | Kavaler | 342/128 |
| 8,279,107 | B2 | 10/2012 | Krstanovic et al. | 342/27 |
| D672,525 | S | 12/2012 | Lee et al. | D99/28 |
| D674,985 | S | 1/2013 | Lee | D99/28 |
| D677,035 | S | 2/2013 | Lee et al. | D99/28 |
| 8,395,532 | B2 | 3/2013 | Chauvin et al. | 340/932.2 |
| 8,402,281 | B2 | 3/2013 | Dahl | 718/189 |
| D680,156 | S | 4/2013 | Hernandez et al. | D18/4.4 |
| D681,717 | S | 5/2013 | Helgesson et al. | D18/4.6 |
| 8,450,627 | B2 | 5/2013 | Mittleman et al. | 200/600 |
| D683,779 | S | 6/2013 | Uemachi et al. | D16/202 |
| D683,794 | S | 6/2013 | Randall | D20/8 |
| D683,795 | S | 6/2013 | Randall | D20/8 |
| D684,745 | S | 6/2013 | Reuter et al. | D99/28 |
| D684,870 | S | 6/2013 | Jones et al. | D10/42 |
| 8,479,909 | B2 | 7/2013 | King et al. | 194/302 |
| 8,487,754 | B2 | 7/2013 | Mitschele | 340/539.1 |
| 8,513,832 | B2 | 8/2013 | Hunter et al. | 307/66 |
| D690,771 | S | 10/2013 | Randall | D20/9 |
| D691,165 | S | 10/2013 | Attoma | D14/486 |
| 8,566,159 | B2 | 10/2013 | King et al. | 705/14.53 |
| D693,983 | S | 11/2013 | Budde et al. | D99/28 |
| 8,589,216 | B2 | 11/2013 | Yu et al. | 705/13 |
| 8,590,687 | B2 | 11/2013 | King et al. | 194/350 |
| 8,595,054 | B2 | 11/2013 | King et al. | 705/13 |
| D696,484 | S | 12/2013 | Lee et al. | D99/28 |
| D696,485 | S | 12/2013 | Lee et al. | D99/28 |
| 8,631,921 | B2 | 1/2014 | Jones et al. | 194/350 |
| 8,662,279 | B2 | 3/2014 | Jones et al. | 194/350 |
| 8,666,801 | B2 | 3/2014 | Cho | 705/13 |
| D702,913 | S | 4/2014 | Budde et al. | D99/28 |
| D702,914 | S | 4/2014 | Budde et al. | D99/28 |
| 8,684,158 | B2 | 4/2014 | Jones et al. | 194/215 |
| D705,090 | S | 5/2014 | MacKay et al. | D10/42 |
| 8,727,207 | B1 | 5/2014 | Church et al. | 235/33 |
| D707,140 | S | 6/2014 | King et al. | D10/42 |
| D707,141 | S | 6/2014 | King et al. | D10/42 |
| D707,142 | S | 6/2014 | King et al. | D10/42 |
| 8,749,403 | B2 | 6/2014 | King et al. | 340/932.2 |
| 8,770,371 | B2 | 7/2014 | MacKay et al. | 194/350 |
| 8,807,317 | B2 | 8/2014 | MacKay et al. | 194/350 |
| D714,165 | S | 9/2014 | Salama | D10/42 |
| D716,156 | S | 10/2014 | Jones et al. | D10/42 |
| D716,515 | S | 10/2014 | Cha et al. | D99/28 |
| 8,862,494 | B2 | 10/2014 | King et al. | 705/13 |
| D716,671 | S | 11/2014 | Jones et al. | D10/42 |
| D722,740 | S | 2/2015 | Budde et al. | D99/28 |
| D724,290 | S | 3/2015 | Cha et al. | D99/28 |
| D724,811 | S | 3/2015 | Reitinger | D99/28 |
| D724,812 | S | 3/2015 | Cha et al. | D99/28 |
| D728,190 | S | 4/2015 | Sheley | D99/28 |
| 9,002,723 | B2 | 4/2015 | King et al. | 340/932.2 |
| 9,047,712 | B2 | 6/2015 | King et al. | 705/1.1 |
| D733,585 | S | 7/2015 | Jones et al. | D10/42 |
| D735,437 | S | 7/2015 | Randall | D99/28 |
| D735,438 | S | 7/2015 | Randall | D99/28 |
| D735,439 | S | 7/2015 | Randall | D99/28 |
| D735,440 | S | 7/2015 | Randall | D99/28 |
| D735,963 | S | 8/2015 | Randall | D99/28 |
| D735,964 | S | 8/2015 | Randall | D99/28 |
| D735,965 | S | 8/2015 | Randall | D99/28 |
| D739,637 | S | 9/2015 | Randall | D99/28 |
| D739,638 | S | 9/2015 | Randall | D99/28 |
| D739,639 | S | 9/2015 | Randall | D99/28 |
| 9,127,964 | B2 | 9/2015 | Schwarz et al. | 340/943 |
| D742,090 | S | 10/2015 | Randall | D99/28 |
| 9,196,097 | B2 | 11/2015 | Jones et al. | 340/870.02 |
| D746,015 | S | 12/2015 | King et al. | D99/28 |
| D748,364 | S | 1/2016 | King et al. | D99/28 |
| D748,888 | S | 2/2016 | King et al. | D99/28 |
| D749,000 | S | 2/2016 | King et al. | D10/42 |
| D750,513 | S | 3/2016 | King et al. | D10/70 |
| D755,649 | S | 5/2016 | King et al. | D10/42 |
| D755,650 | S | 5/2016 | King et al. | D10/42 |
| D756,807 | S | 5/2016 | King et al. | D10/42 |
| D756,808 | S | 5/2016 | King et al. | D10/42 |
| D762,040 | S | 7/2016 | King et al. | D99/28 |
| 9,391,474 | B2 | 7/2016 | Hunter et al. | H02J 9/06 |
| 2001/0012241 | A1 | 8/2001 | Dee et al. | 368/90 |
| 2001/0047278 | A1 | 11/2001 | Brookner et al. | 705/1 |
| 2001/0051531 | A1 | 12/2001 | Singhal et al. | 455/556 |
| 2002/0008639 | A1 | 1/2002 | Dee | 340/932.2 |
| 2002/0030606 | A1 | 3/2002 | Chauvin et al. | 340/932.2 |
| 2002/0062172 | A1 | 5/2002 | Bench et al. | 700/232 |
| 2002/0074344 | A1 | 6/2002 | Long et al. | 222/71 |
| 2002/0080013 | A1 | 6/2002 | Anderson, III et al. | 340/425.5 |
| 2002/0111768 | A1 | 8/2002 | Ghorayeb et al. | 702/178 |
| 2002/0134645 | A1 | 9/2002 | Alexander et al. | 194/351 |
| 2003/0017904 | A1 | 1/2003 | Lee | 475/232 |
| 2003/0092387 | A1 | 5/2003 | Hjelmvik | 455/41 |
| 2003/0112151 | A1 | 6/2003 | Chauvin et al. | 340/870.02 |
| 2003/0112597 | A1 | 6/2003 | Smith | 361/685 |
| 2003/0117904 | A1 | 6/2003 | Lank et al. | |
| 2003/0121754 | A1 | 7/2003 | King | 194/302 |
| 2003/0128010 | A1 | 7/2003 | Hsu | 320/101 |
| 2003/0128136 | A1 | 7/2003 | Spier et al. | 340/932.2 |
| 2003/0132840 | A1 | 7/2003 | Bahar | 340/541 |
| 2003/0135407 | A1 | 7/2003 | Reinhardt et al. | 705/13 |
| 2003/0140531 | A1 | 7/2003 | Pippins | 37/456 |
| 2003/0144905 | A1 | 7/2003 | Smith | 705/14 |
| 2003/0144972 | A1 | 7/2003 | Cordery et al. | 705/401 |
| 2003/0169183 | A1 | 9/2003 | Korepanov et al. | 340/932.2 |
| 2003/0179107 | A1 | 9/2003 | Kibria et al. | 340/932.2 |
| 2003/0220835 | A1 | 11/2003 | Barnes, Jr. | 705/14 |
| 2003/0222792 | A1 | 12/2003 | Berman et al. | 340/932.2 |
| 2003/0234888 | A1 | 12/2003 | Hong et al. | 348/375 |
| 2004/0011099 | A1 | 1/2004 | Andersson | 70/371 |
| 2004/0016796 | A1 | 1/2004 | Hanna et al. | 235/375 |
| 2004/0039632 | A1 | 2/2004 | Han et al. | 705/13 |
| 2004/0040028 | A1 | 2/2004 | Moreau | 719/310 |

(56) References Cited

U.S. PATENT DOCUMENTS

| | | | | |
|---|---|---|---|---|
| 2004/0068434 | A1 | 4/2004 | Kanekon | |
| 2004/0084278 | A1 | 5/2004 | Harris et al. | 194/302 |
| 2004/0094619 | A1 | 5/2004 | Silberberg | 235/382 |
| 2004/0160905 | A1 | 8/2004 | Bernier et al. | 370/310 |
| 2004/0181496 | A1 | 9/2004 | Odinotski et al. | 705/418 |
| 2004/0232878 | A1 | 11/2004 | Couch et al. | 320/101 |
| 2004/0243526 | A1 | 12/2004 | Krygler et al. | 705/418 |
| 2004/0254900 | A1 | 12/2004 | Reinhard | 705/418 |
| 2004/0262379 | A1 | 12/2004 | Gomes | 235/379 |
| 2004/0263117 | A1 | 12/2004 | Kogan et al. | 320/114 |
| 2004/0264302 | A1 | 12/2004 | Ward, II | 368/90 |
| 2005/0029340 | A1 | 2/2005 | Ferraro | 235/379 |
| 2005/0035740 | A1 | 2/2005 | Elder et al. | 320/116 |
| 2005/0040951 | A1 | 2/2005 | Zalewski et al. | 340/572.1 |
| 2005/0068201 | A1 | 3/2005 | Wulff et al. | 341/20 |
| 2005/0155839 | A1 | 7/2005 | Banks et al. | 194/302 |
| 2005/0168352 | A1 | 8/2005 | Tomer | 340/932.2 |
| 2005/0178639 | A1 | 8/2005 | Brumfield et al. | 194/350 |
| 2005/0192911 | A1 | 9/2005 | Mattern | 705/401 |
| 2006/0020487 | A1 | 1/2006 | Spittel et al. | 705/1 |
| 2006/0021848 | A1 | 2/2006 | Smith | 194/350 |
| 2006/0114159 | A1 | 6/2006 | Yoshikawa et al. | |
| 2006/0116972 | A1 | 6/2006 | Wong | 705/418 |
| 2006/0136131 | A1 | 6/2006 | Dugan et al. | 701/300 |
| 2006/0149684 | A1 | 7/2006 | Matsuura et al. | 705/65 |
| 2006/0152349 | A1 | 7/2006 | Ratnakar | 340/426.1 |
| 2006/0152385 | A1 | 7/2006 | Mandy | 340/932.2 |
| 2006/0173733 | A1 | 8/2006 | Fancher | 705/13 |
| 2006/0255119 | A1 | 11/2006 | Marchasin et al. | 235/375 |
| 2006/0259354 | A1 | 11/2006 | Yan | 705/13 |
| 2006/0267799 | A1 | 11/2006 | Mendelson | 340/932.2 |
| 2007/0011700 | A1 | 1/2007 | Johnson | 725/34 |
| 2007/0016539 | A1 | 1/2007 | Groft et al. | 705/418 |
| 2007/0017265 | A1 | 1/2007 | Andersson | 70/379 |
| 2007/0029825 | A1 | 2/2007 | Franklin et al. | 293/128 |
| 2007/0044523 | A1 | 3/2007 | Davis | 70/34 |
| 2007/0046651 | A1 | 3/2007 | Sinclair et al. | 345/173 |
| 2007/0061155 | A1 | 3/2007 | Ji et al. | 705/1 |
| 2007/0094153 | A1 | 4/2007 | Ferraro | 705/67 |
| 2007/0114849 | A1 | 5/2007 | Falik et al. | 307/64 |
| 2007/0119682 | A1 | 5/2007 | Banks et al. | 194/239 |
| 2007/0129974 | A1 | 6/2007 | Chen et al. | 705/5 |
| 2007/0136128 | A1 | 6/2007 | Janacek et al. | 705/13 |
| 2007/0171069 | A1 | 7/2007 | Allen | 340/572.1 |
| 2007/0184852 | A1 | 8/2007 | Johnson et al. | 455/456.1 |
| 2007/0208499 | A1 | 9/2007 | Kwong | 701/117 |
| 2007/0210935 | A1 | 9/2007 | Yost et al. | 340/932.2 |
| 2007/0276724 | A1 | 11/2007 | Catt | 705/13 |
| 2007/0285281 | A1 | 12/2007 | Welch | 340/932.2 |
| 2008/0071611 | A1 | 3/2008 | Lovett | 705/13 |
| 2008/0093454 | A1 | 4/2008 | Yamazaki et al. | |
| 2008/0147268 | A1 | 6/2008 | Fuller | 701/35 |
| 2008/0158010 | A1 | 7/2008 | Nath et al. | 340/932.2 |
| 2008/0165030 | A1 | 7/2008 | Kuo et al. | 340/932.2 |
| 2008/0208680 | A1 | 8/2008 | Cho | 705/13 |
| 2008/0218383 | A1 | 9/2008 | Franklin et al. | 340/937 |
| 2008/0238715 | A1 | 10/2008 | Cheng et al. | 340/870.03 |
| 2008/0245638 | A1 | 10/2008 | King et al. | 194/350 |
| 2008/0257965 | A1 | 10/2008 | Klein et al. | 235/483 |
| 2008/0265019 | A1 | 10/2008 | Artino et al. | 235/379 |
| 2008/0266138 | A1 | 10/2008 | Ponert | 340/932.2 |
| 2008/0270227 | A1 | 10/2008 | Al Amri | 705/13 |
| 2008/0277468 | A1 | 11/2008 | Mitschele | 235/384 |
| 2008/0289030 | A1 | 11/2008 | Poplett | 726/15 |
| 2008/0291054 | A1 | 11/2008 | Groft | 340/932.2 |
| 2008/0296365 | A1 | 12/2008 | Schliebe | 235/379 |
| 2008/0319837 | A1 | 12/2008 | Mitschele | 705/13 |
| 2009/0026842 | A1 | 1/2009 | Hunter et al. | 307/66 |
| 2009/0032368 | A1 | 2/2009 | Hunter et al. | 194/318 |
| 2009/0049875 | A1 | 2/2009 | Buhl et al. | 70/52 |
| 2009/0057398 | A1 | 3/2009 | Douglass et al. | 235/379 |
| 2009/0083149 | A1 | 3/2009 | Maekawa et al. | 705/14 |
| 2009/0095593 | A1 | 4/2009 | King et al. | 194/302 |
| 2009/0099761 | A1 | 4/2009 | Davis et al. | 701/120 |
| 2009/0102726 | A1 | 4/2009 | Imano et al. | |
| 2009/0109062 | A1 | 4/2009 | An | 340/932.2 |
| 2009/0137204 | A1 | 5/2009 | Chang | 455/41.1 |
| 2009/0159674 | A1 | 6/2009 | King et al. | 235/382 |
| 2009/0183966 | A1 | 7/2009 | King et al. | 194/217 |
| 2009/0192950 | A1 | 7/2009 | King et al. | 705/418 |
| 2009/0199966 | A1 | 8/2009 | Coleman et al. | |
| 2009/0254438 | A1 | 10/2009 | Johnson, Jr. et al. | 705/17 |
| 2009/0267732 | A1 | 10/2009 | Chauvin et al. | 340/5.53 |
| 2009/0284907 | A1 | 11/2009 | Regimbal et al. | 361/679.02 |
| 2009/0287578 | A1 | 11/2009 | Paluszek et al. | 705/17 |
| 2009/0315720 | A1 | 12/2009 | Clement et al. | 340/573.5 |
| 2010/0019936 | A1 | 1/2010 | Kaveler | 340/933 |
| 2010/0025459 | A1 | 2/2010 | Yamada | 235/375 |
| 2010/0026522 | A1 | 2/2010 | Ward, II | 340/932.2 |
| 2010/0030629 | A1 | 2/2010 | Ward, II | 705/13 |
| 2010/0106517 | A1 | 4/2010 | Kociubinski et al. | 705/2 |
| 2010/0153193 | A1 | 6/2010 | Ashby et al. | 705/13 |
| 2010/0161489 | A1 | 6/2010 | Goodall et al. | 705/45 |
| 2010/0187300 | A1 | 7/2010 | Ramachandran et al. | 235/379 |
| 2010/0188932 | A1 | 7/2010 | Hanks et al. | 367/140 |
| 2010/0241564 | A1 | 9/2010 | Miller et al. | 705/43 |
| 2010/0243729 | A1 | 9/2010 | Russell et al. | 235/379 |
| 2010/0328104 | A1 | 12/2010 | Groft | 340/932.2 |
| 2010/0332394 | A1 | 12/2010 | Ioli | 705/44 |
| 2011/0022427 | A1 | 1/2011 | Dayan | 705/5 |
| 2011/0037562 | A1 | 2/2011 | Braukmann et al. | |
| 2011/0057815 | A1 | 3/2011 | King et al. | 340/932.2 |
| 2011/0060653 | A1 | 3/2011 | King et al. | 705/14.58 |
| 2011/0063133 | A1 | 3/2011 | Keller et al. | 340/932.2 |
| 2011/0066297 | A1 | 3/2011 | Saberi et al. | 700/287 |
| 2011/0093314 | A1 | 4/2011 | Redmann et al. | |
| 2011/0122036 | A1 | 5/2011 | Leung et al. | |
| 2011/0133613 | A1 | 6/2011 | Descamps et al. | 312/223.1 |
| 2011/0158331 | A1 | 6/2011 | Kavaler et al. | 375/259 |
| 2011/0203901 | A1 | 8/2011 | King et al. | 194/211 |
| 2011/0205087 | A1 | 8/2011 | Kell et al. | 340/932.2 |
| 2011/0221624 | A1 | 9/2011 | Kavaler | 342/22 |
| 2011/0261548 | A1 | 10/2011 | Gandhi | |
| 2011/0276519 | A1 | 11/2011 | MacKay et al. | 705/418 |
| 2011/0313822 | A1 | 12/2011 | Burdick | 705/13 |
| 2011/0320243 | A1 | 12/2011 | Khan | 705/13 |
| 2012/0026015 | A1 | 2/2012 | Kavaler | 340/933 |
| 2012/0158466 | A1 | 6/2012 | John | 705/13 |
| 2012/0173171 | A1 | 7/2012 | Bajwa et al. | 702/56 |
| 2012/0208521 | A1 | 8/2012 | H ger et al. | 455/422.1 |
| 2012/0222935 | A1 | 9/2012 | MacKay et al. | 194/210 |
| 2012/0273322 | A1 | 11/2012 | MacKay et al. | 194/210 |
| 2012/0285790 | A1 | 11/2012 | Jones et al. | 194/217 |
| 2012/0285791 | A1 | 11/2012 | Jones et al. | 194/217 |
| 2012/0285792 | A1 | 11/2012 | Jones et al. | 194/217 |
| 2012/0285793 | A1 | 11/2012 | Jones et al. | 194/217 |
| 2012/0286036 | A1 | 11/2012 | Jones et al. | 235/380 |
| 2012/0286968 | A1 | 11/2012 | Jones et al. | 340/870.02 |
| 2012/0292385 | A1 | 11/2012 | MacKay et al. | 235/375 |
| 2013/0005445 | A1 | 1/2013 | Walker et al. | 463/25 |
| 2013/0027218 | A1 | 1/2013 | Schwarz et al. | 340/870.02 |
| 2013/0085928 | A1 | 4/2013 | McKinney | 705/39 |
| 2013/0099943 | A1 | 4/2013 | Subramanya | 340/933 |
| 2013/0124270 | A1 | 5/2013 | Tziperman et al. | 705/13 |
| 2013/0238406 | A1 | 9/2013 | King et al. | 705/13 |
| 2013/0285455 | A1 | 10/2013 | Hunter et al. | 307/66 |
| 2014/0040028 | A1 | 2/2014 | King et al. | 705/14.53 |
| 2014/0058805 | A1 | 2/2014 | Paesler et al. | 705/13 |
| 2014/0108107 | A1 | 4/2014 | Jones et al. | 705/13 |
| 2014/0129158 | A1 | 5/2014 | Shea | 702/57 |
| 2014/0172518 | A1 | 6/2014 | King et al. | 705/13 |
| 2014/0174881 | A1 | 6/2014 | King et al. | 194/350 |
| 2014/0210646 | A1 | 7/2014 | Subramanya | 340/928 |
| 2014/0213176 | A1 | 7/2014 | Mendelson | 455/39 |
| 2014/0214499 | A1 | 7/2014 | Hudson et al. | 705/13 |
| 2014/0231505 | A1 | 8/2014 | King et al. | 235/375 |
| 2014/0279565 | A1 | 9/2014 | Trump et al. | 705/72 |
| 2014/0289025 | A1 | 9/2014 | King et al. | 705/13 |
| 2014/0319211 | A1 | 10/2014 | MacKay et al. | 235/380 |
| 2015/0084786 | A1 | 3/2015 | King et al. | 340/870.02 |

(56) References Cited

U.S. PATENT DOCUMENTS

| | | | | |
|---|---|---|---|---|
| 2015/0106172 | A1 | 4/2015 | Salama | G07F 17/246 |
| 2015/0235503 | A1 | 8/2015 | King et al. | G07F 17/248 |
| 2015/0332587 | A1 | 11/2015 | Schwarz et al. | G08G 1/017 |

FOREIGN PATENT DOCUMENTS

| | | | |
|---|---|---|---|
| AU | 2006203554 | 9/2006 | G07C 1/30 |
| AU | 314132 | 5/2007 | |
| AU | 315845 | 8/2007 | |
| AU | 315846 | 8/2007 | |
| AU | 315847 | 8/2007 | |
| CA | 2233931 | 4/1997 | G08G 1/14 |
| CA | 2260925 | 1/1998 | G07B 15/00 |
| CA | 2227833 | 7/1998 | G07F 17/24 |
| CA | 2346908 | 4/2000 | G07C 1/30 |
| CA | 2352968 | 1/2001 | G07F 17/24 |
| CA | 2401429 | 9/2001 | G07C 1/30 |
| CA | 2377010 | 12/2001 | G06F 19/00 |
| CA | 2357179 | 3/2002 | G08C 17/00 |
| CA | 2437722 | 8/2002 | G08G 1/14 |
| CA | 2453369 | 1/2003 | G07C 1/30 |
| CA | 2363915 | 5/2003 | G07F 17/24 |
| CA | 2413198 | 5/2003 | G07F 17/24 |
| CA | 2414132 | 6/2003 | G07F 17/24 |
| CA | 2248347 | 10/2005 | G07C 1/30 |
| CA | 2595309 | 7/2006 | G08G 1/14 |
| CA | 2511461 | 2/2007 | G07C 1/30 |
| CA | 2631699 | 6/2007 | G06Q 10/00 |
| CA | 2622164 | 8/2008 | G07F 17/24 |
| CA | 122930 | 9/2008 | |
| CA | 126745 | 9/2008 | |
| CA | 2693911 | 1/2009 | G06Q 50/00 |
| CA | 2650192 | 7/2009 | G08C 17/02 |
| CA | 2650195 | 7/2009 | G01D 4/02 |
| CA | 2933066 | 7/2009 | G07F 17/24 |
| CA | 2387540 | 4/2010 | G07F 17/24 |
| CA | 134041 | 9/2010 | |
| CA | 134042 | 9/2010 | |
| CA | 2773132 | 3/2011 | G06Q 30/00 |
| CA | 2773135 | 3/2011 | G06Q 20/00 |
| CA | 2770093 | 5/2012 | G07C 1/30 |
| CA | 2870592 | 5/2012 | G07F 17/24 |
| CA | 2874155 | 5/2012 | G07F 17/24 |
| CA | 155382 | 5/2015 | |
| CA | 155383 | 5/2015 | |
| CA | 155391 | 5/2015 | |
| CA | 156990 | 5/2015 | |
| CA | 156991 | 5/2015 | |
| CA | 156992 | 5/2015 | |
| CA | 156993 | 5/2015 | |
| CA | 156994 | 5/2015 | |
| CA | 156995 | 5/2015 | |
| CA | 157067 | 5/2015 | |
| CA | 157068 | 5/2015 | |
| CA | 157069 | 5/2015 | |
| CA | 161049 | 10/2015 | |
| CA | 160598 | 2/2016 | |
| CA | 163369 | 2/2016 | |
| CA | 163370 | 2/2016 | |
| CN | 2395344 | 9/2000 | G07F 17/24 |
| CN | 2544352 | 4/2003 | G06F 19/00 |
| CN | 1549990 | 11/2004 | G07B 15/02 |
| DE | 28 04 085 A1 | 2/1977 | |
| DE | 27 50 193 C2 | 11/1977 | |
| DE | 102005041290 | 3/2007 | G07B 15/02 |
| EP | 0329129 | 8/1989 | G07F 17/24 |
| EP | 980055 | 2/2000 | G07F 17/24 |
| EP | 1327962 | 7/2003 | G07B 15/02 |
| EP | 1376491 | 1/2004 | G07F 7/00 |
| EP | 1748393 | 1/2007 | G07C 1/30 |
| EP | 1128350 | 10/2007 | G07B 15/02 |
| EP | 1898360 | 3/2008 | G07B 15/02 |
| EP | 2215605 | 8/2012 | G07B 15/02 |
| FR | 2837583 | 9/2003 | G06K 19/077 |
| GB | 1 237 579 | 12/1968 | |
| GB | 1 283 555 | 10/1969 | |
| GB | 1431862 | 4/1976 | G08B 25/00 |
| GB | 2155228 | 9/1985 | G09F 23/00 |
| GB | 2298510 | 9/1996 | G06F 7/10 |
| JP | S58121494 | 7/1983 | G07C 1/30 |
| JP | S6437661 | 2/1989 | F04H 6/00 |
| JP | 01165494 | 6/1989 | B42D 15/10 |
| JP | 01303026 | 12/1989 | G11C 5/00 |
| JP | 0261711 | 3/1990 | G06F 1/26 |
| JP | 0487533 | 3/1992 | H02J 9/00 |
| JP | H08305998 | 11/1996 | E04H 6/00 |
| JP | S5259000 | 5/1997 | G07C 1/30 |
| JP | 2002074430 | 3/2002 | G06Q 50/00 |
| JP | 2002099640 | 4/2002 | G06Q 10/00 |
| JP | 2002528799 | 9/2002 | G06Q 50/00 |
| JP | 2003527701 | 9/2003 | G06Q 40/00 |
| JP | 2005242888 | 9/2005 | G06Q 10/00 |
| JP | 2005267430 | 9/2005 | G06Q 10/00 |
| JP | 2007052773 | 3/2007 | G07F 17/24 |
| JP | 2011060206 | 3/2011 | G07B 15/00 |
| KR | 20000016671 | 3/2000 | G07F 17/24 |
| KR | 20010028481 | 4/2001 | G07B 1/00 |
| KR | 20050038077 | 4/2005 | G07B 5/12 |
| KR | 1020080026282 | 3/2008 | G06F 19/00 |
| KR | 20080041730 | 5/2008 | G06T 7/20 |
| MX | 2008007047 | 8/2008 | G06Q 10/00 |
| NZ | 530606 | 11/2006 | G07C 1/30 |
| WO | WO 81/00778 | 3/1981 | |
| WO | WO9520204 | 7/1995 | G07F 17/24 |
| WO | WO9611453 | 4/1996 | G07C 1/30 |
| WO | WO97/12345 | 4/1997 | G07F 17/24 |
| WO | WO9737328 | 10/1997 | G07B 15/02 |
| WO | WO98/04080 | 1/1998 | H04M 15/00 |
| WO | WO0059201 | 10/2000 | H04M 15/00 |
| WO | WO01/69541 | 9/2001 | G07F 17/24 |
| WO | WO0180157 | 10/2001 | G06F 19/00 |
| WO | WO02063570 | 8/2002 | |
| WO | WO03009238 | 1/2003 | G07C 1/30 |
| WO | WO2004012352 | 2/2004 | H04B 1/38 |
| WO | WO2005031494 | 4/2005 | |
| WO | WO2006076773 | 7/2006 | G08G 1/14 |
| WO | WO2006095352 | 9/2006 | H02J 9/06 |
| WO | WO2007063530 | 6/2007 | G06Q 10/00 |
| WO | WO2009009854 | 1/2009 | G06Q 50/00 |
| WO | WO2009154787 | 12/2009 | G08G 1/14 |
| WO | WO2010008610 | 1/2010 | G08G 1/065 |
| WO | WO2010071974 | 7/2010 | G07C 1/30 |
| WO | WO2011029061 | 3/2011 | G06Q 30/00 |
| WO | WO2011029062 | 3/2011 | G06Q 20/00 |
| WO | WO2012015453 | 2/2012 | G08G 1/042 |
| WO | WO2012092609 | 7/2012 | G08G 1/01 |
| WO | WO2012154902 | 11/2012 | G07F 17/14 |
| WO | WO2012154913 | 11/2012 | G06Q 50/30 |
| WO | WO2013016453 | 1/2013 | G07B 15/02 |
| WO | WO2013049418 | 4/2013 | |
| WO | WO2014014494 | 1/2014 | G07B 15/02 |

OTHER PUBLICATIONS

Barefoot, D., "There'll be lies, there'll be tears, a jury of your peers," DarrenBarefoot.com: Dec. 2005, pp. 8-9 (39 pages).

Canadian Office Action issued in application 2,870,544, dated Jan. 19, 2015 (5 pgs).

Digital Payment Technologies—LUKE website, https://web.archive.org/web/20061025094839/http:www.digitalpaytech.com/luke.html, Oct. 25, 2006 (5 pgs).

*Duncan Parking Technologies, Inc.* v. *IPS Group Inc.*, Petition for *Inter Partes* Review of U.S. Pat. No. 7,854,310, IPR2016-00067, Oct. 22, 2015 (66 pgs).

*Duncan Parking Technologies, Inc.* v. *IPS Group Inc.*, Petition for *Inter Partes* Review of U.S. Pat. No. 7,854,310, IPR2016-00068, Oct. 22, 2015 (64 pgs).

*Duncan Parking Technologies, Inc.* v. *IPS Group Inc.*, Petition for *Inter Partes* Review of U.S. Pat. No. 8,595,054, IPR2016-00069, Oct. 22, 2015 (67 pgs).

*Duncan Parking Technologies, Inc.* v. *IPS Group Inc.*, Petition for *Inter Partes* Review of U.S. Pat. No. 8,595,054, IPR2016-00070, Oct. 22, 2015 (61 pgs).

(56) References Cited

OTHER PUBLICATIONS

Duncan Solutions—AutoCITE brochure, 2013 (2 pgs).
Duncan Solutions—Eagle 2100 brochure, 2013 (2 pgs).
Duncan Solutions—Eagle CK brochure, 2013 (2 pgs).
Duncan Solutions—Intermec CN50 webpage, Mar. 8, 2011 (2 pgs).
Duncan Solutions—Motorola MC75 webpage, Mar. 8, 2011 (2 pgs).
Duncan Solutions—VM Pay-by-Space Multi-Space Meter brochure, 2013 (2 pgs).
Exhibit 1003—Declaration of Todd Magness in Support of Petition for *Inter Partes* Review of U.S. Pat. No. 7,854,310, dated Oct. 21, 2015 (70 pgs).
Exhibit 1004—Declaration of Anderson Moore in Support of Petition for *Inter Partes* Review of U.S. Pat. No. 8,595,054, dated Oct. 21, 2015 (19 pgs).
Exhibit 1005—U.S. Appl. No. 60/741,920, filed Dec. 2, 2005 (20 pgs).
Exhibit 1009—Tung, Y., "Design of an Advanced On-street Parking Meter," Thesis, Rochester Institute of Technology, 2001 (25 pgs).
Exhibit 1010—Christian, S.E., "Parking Meter Winding Up for Computer Age," Chicago Tribune, May 19, 1995 (6 pgs).
Exhibit 1011—Associated Press, "New parking meters based on computer," The San Diego Union, Feb. 1, 1987 (1 pg).
Exhibit 1012—Lunden, J., Good Morning America transcript, Nov. 6, 1986 (3 pgs).
Exhibit 1013—LUKE Parking Station ad (p. 28), Parking Today, vol. 10, No. 4, Apr. 2005 (64 pgs).
Exhibit 1014—Blass, E., "Changing times," Lansing State Journal, Feb. 19, 1987 (1 pg).
Exhibit 1015—Gabriele, M.C., "Electronic Parking Meters Rival Mechanical Units," American Metal Market/Metalworking News, Sep. 29, 1986 (1 pg).
Exhibit 1016—Sandler, L., "Lovely VISA, meter maid: Use credit card to park," Milwaukee Journal Sentinel, Jun. 13, 2005 (1 pg).
Exhibit 1017—Item for Finance Committee, "Capital Works Reserve Fund, Head 708—Capital Subventions and Major Systems and Equipment," FCR(Mar. 2002)18, May 24, 2002 (15 pgs).
Exhibit 1018—Anonymous, "Happy %#@! Anniversary, First Parking Meter Installed Jul. 16, 1935," The Expired Meter News, Views, Information on Driving in Chicago, Jul. 16, 2009 (10 pgs).
Exhibit 1019—Anonymous, Parking Meter Patented 72 Years Ago Today, The Expired Meter News, Views, Information on Driving in Chicago, May 24, 2010 (6 pgs).
Exhibit 1020—U.S. Pat. No. 2,118,318 to Magee, May 24, 1938 (11 pgs).
Exhibit 1032—U.S. Pat. No. 5,570,771 to Jacobs, Nov. 5, 1996 (29 pgs).
Exhibit 1034—Anonymous, "Smart Cards and Parking," TC-06001, Smart Card Alliance Transportation Council White Paper, Jan. 2006 (52 pgs).
Exhibit 1037—Catalog Entry for Exhibit 1009, Tung, Y., "Design of an advanced on-street parking meter," Oct. 18, 2015 (2 pgs).
Exhibit 1038—POM Parking Meters website, Oct. 20, 2015 (4 pgs).
International Search Report issued in application No. PCT/US2012/037229, dated Jan. 28, 2013 (6 pgs).
International Search Report issued in application No. PCT/US2012/037205, dated Oct. 4, 2012 (3 pgs).
Notice of Allowance issued in U.S. Appl. No. 13/546,918, dated Nov. 20, 2015 (12 pgs).
Notice of Allowance issued in U.S. Appl. No. 14/325,134, dated Feb. 3, 2016 (14 pgs).
Notice of Allowance issued in U.S. Appl. No. 29/477,339, dated Apr. 1, 2015 (3 pgs).
Notice of Allowance issued in U.S. Appl. No. 29/477,402, dated Aug. 3, 2015 (3 pgs).
Notice of Allowance issued in U.S. Appl. No. 29/477,405, dated Apr. 1, 2015 (10 pgs).
Office Action issued in U.S. Appl. No. 14/325,134, dated Nov. 24, 2015 (22 pgs).
Office Action issued in U.S. Appl. No. 14/698,806, dated Dec. 14, 2015 (9 pgs).
Office Action issued in U.S. Appl. No. 29/477,200, dated Apr. 9, 2015 (9 pgs).
Office Action issued in U.S. Appl. No. 29/477,201, dated Apr. 9, 2015 (9 pgs).
Office Action issued in U.S. Appl. No. 29/477,204, dated Apr. 9, 2015 (9 pgs).
Office Action issued in U.S. Appl. No. 29/477,321, dated May 15, 2015 (9 pgs).
Office Action issued in U.S. Appl. No. 29/477,324, dated Apr. 23, 2015 (9 pgs).
Office Action issued in U.S. Appl. No. 29/477,329, dated May 22, 2015 (11 pgs).
Office Action issued in U.S. Appl. No. 29/477,402, dated Apr. 9, 2015 (15 pgs).
Photo Violation Technologies—Revolutionizing the Industry by Perfecting How People Park, https://web.archive.org/web/20070628195927/http://www.photoviolation.com/, Jun. 28, 2007 (50 pgs).
Photo Violation Technologies Corp.—Products, Oct. 2, 2015 (3 pgs).
Spyker, R.L., "Predicting capacitor run time for a battery/capacitor hybrid source," Power Electronic Drives and Energy Systems for Industrial Growth, 1998, abstract only (2 pgs).
Written Opinion issued in application No. PCT/US2012/037205, dated Oct. 4, 2012 (5 pgs).
Written Opinion issued in application No. PCT/US2012/037229, dated Jan. 28, 2013 (6 pgs).
Office Action issued in U.S. Appl. No. 13/468,881, dated Sep. 4, 2013 (13 pgs).
Office Action issued in U.S. Appl. No. 29/455,221, dated Jan. 13, 2014 (10 pgs).
(Cell Net Data Systems) "First Wireless Monitoring of Parking Meters Results in Theft Arrests Using CellNet Data Systems Technology," PRNewswire, May 11, 1999 (2 pgs).
Anonymous, "The Originators of Metered Parking, Series II, APM-E Mechanism, Service Manual," POM Incorporated, May 23, 2006 revision (22 pgs).
Basu et al., "Networked Parking Spaces: Architecture and Applications," MCL Technical Report No. 07-01-2002, Proc. IEEE Vehicular Transportation Conference, Vancouver, Canada, Sep. 2002 (10 pgs).
Bayless et al., "Smart Parking and the Connected Consumer," ITS America Research, Dec. 2012 (39 pgs).
Bernspång, F., "Smart Parking using Magnetometers and Mobile Applications," Master's Thesis, Master of Science in Engineering Technology, Computer Science and Engineering, Luleå University of Technology, Nov. 2010-May 2011 (35 pgs).
Burden et al., "Near Field Communications (NFC) in Public Transport," Digital Identity Forum, 2006 (18 pgs).
Byrd, Dennis, "City officials plug solar-powered parking meters, Electronic eye ends free parking," Lawrence Journal World, Apr. 30, 1989, p. 11C (1 pg).
Byrd, Dennis, Parking Meter Manufacturer Sees Bright Future for New Sun-Powered Devices, Los Angeles Times, May 14, 1989 (2 pgs).
Canadian Office Action issued for related application No. 2,745,365, dated Jul. 4, 2012 (2 pgs).
Canadian Office Action issued for related application No. 2,745,365, dated Jun. 5, 2012 (2 pgs).
Canadian Office Action issued for related application No. 2,745,365, dated Aug. 26, 2011 (4 pgs).
Canadian Office Action issued for related application No. 2,745,365, dated Mar. 1, 2012 (6 pgs).
Canadian Office Action issued for related application No. 2,770,093, dated Jul. 5, 2012 (5 pgs).
Canadian Office Action issued in application No. 2,745,368, dated Aug. 4, 2011 (2 pgs).
Canadian Office Action issued in application No. 2,745,368, dated Nov. 1, 2011 (3 pgs).
Canadian Office Action issued in application No. 2,770,093, dated Apr. 10, 2013 (2 pgs).
Canadian Office Action issued in application No. 2,770,093, dated Jun. 11, 2014 (2 pgs).

(56) References Cited

OTHER PUBLICATIONS

Canadian Office Action issued in application No. 2,770,093, dated Oct. 15, 2014 (3 pgs).
Canadian Office Action issued in application No. 2,770,093, dated Oct. 29, 2012 (2 pgs).
Canadian Office Action issued in application No. 2,773,250, dated Mar. 26, 2015 (10 pgs).
Canadian Office Action issued in application No. 2,773,250, dated Jun. 20, 2013 (3 pgs).
Canadian Office Action issued in application No. 2,773,250, dated Jun. 30, 2014 (3 pgs).
Canadian Office Action issued in application No. 2,773,250, dated Mar. 12, 2014 (5 pgs).
Canadian Office Action issued in application No. 2,773,250, dated Nov. 12, 2014 (10 pgs).
Canadian Office Action issued in application No. 2,773,250, dated Oct. 7, 2013 (4 pgs).
Canadian Office Action issued in application No. 2,870,544, dated Jan. 19, 2015 (5 pgs).
Cosgrove, D., "SmartPark," Senior Project Report, Jun. 12, 2013 (20 pgs).
DAT Self-Service System Limited, Product Brochure, Version 1.0, Date: May 2005, pp. 1-39 (39 pgs), plus English translation (42 pgs).
Duncan Solutions "Single-Space Meters" brochure (2 pgs); Rev. Apr. 2006, 2006 Duncan Solutions, Inc.
Fidelman, C., "Time's running out for parking meters at present locations: $270,000 cited as replacement cost. City employees who ticket motorists find electronic meters unsuitable," The Gazette, Final Edition, Montreal, Quebec, Canada, Nov. 12, 2002, p. A7 (2 pgs).
Flatley, J., "In San Francisco, hackers park for free," posted Jul. 31, 2009, www.engadget.com (1 pg).
Howland, S., "How M2M Maximizes Denver's Revenue," FieldTechnologiesOnline.com, Oct. 2011, pp. 9-12 (4 pgs).
Information Disclosure Statement by Applicant filed for U.S. Appl. No. 12/355,734 on May 23, 2102 (22 pgs).
Information Disclosure Statement by Applicant filed for U.S. Appl. No. 12/355,740 on May 23, 2102 (25 pgs).
Information Disclosure Statement by Applicant filed for U.S. Appl. No. 12/875,959 on May 24, 2102 (22 pgs).
Information Disclosure Statement by Applicant filed for U.S. Appl. No. 12/875,975 on May 24, 2102 (22 pgs).
Information Disclosure Statement by Applicant filed for Oct. 23, 2012 for U.S. Appl. No. 12/355,734 (4 pgs).
International Preliminary Report on Patentability issued in related application No. PCT/CA2012/000191, dated Sep. 12, 2013 (7 pgs).
International Preliminary Report on Patentability, issued for application No. PCT/US2010/047907, dated Mar. 15, 2012 (6 pgs).
International Preliminary Report on Patentability, issued for application No. PCT/US2010/047906, dated Mar. 6, 2012 (5 pgs).
International Preliminary Report on Patentability, issued for application No. PCT/IB2006/054574, dated Mar. 10, 2009 (5 pgs).
International Search Report & Written Opinion, PCT/CA12/000191, dated Jun. 20, 2012 (8 pgs).
International Search Report issued for PCT/US2012/048190, dated Jan. 22, 2013 (4 pgs).
International Search Report issued in related application No. PCT/CA2007/001266, dated Apr. 21, 2008 (3 pgs).
International Search Report, PCT/CA2009/001058, dated Nov. 12, 2009 (4 pgs).
International Search Report, PCT/CA2009/001657, dated Feb. 17, 2010 (2 pgs).
International Search Report, PCT/IB06/054574, dated Oct. 27, 2008 (2 pgs).
International Search Report, PCT/US2010/047906, dated Mar. 30, 2011 (3 pgs).
International Search Report, PCT/US2010/047907, dated Apr. 26, 2011 (3 pgs).
McCullagh, D., "Hackers: We can bypass San Francisco e-parking meters," Jul. 30, 2009, http:///news.cnet.com (2 pgs).
Meter Solutions, Single-Space Meters brochure, downloaded from www.duncansolutions.com website, revised Apr. 2006 (2 pgs).
Micrel, Application Note 51 Frequency Hopping Techniques, Jun. 2006, Rev. 1.0 (8 pgs).
Notice of Allowance issued in application No. 13/546,918, dated Feb. 26, 2015 (24 pgs).
Notice of Allowance issued in application No. 13/546,918, dated Jun. 19, 2015 (13 pgs).
Notice of Allowance issued in application serial No. 13/545,871, dated May 28, 2013 (10 pgs).
Notice of Allowance issued in related application No. 13/410,831, dated Oct. 11, 2013 (33 pgs).
Notice of Allowance issued in related application No. 13/545,871, dated Dec. 16, 2013 (22 pgs).
Notice of Allowance issued in related application No. 29/433,549, dated Feb. 27, 2014 (60 pgs).
Notice of Allowance issued in related application No. 29/489,572 dated Jun. 11, 2014 (10 pgs).
Office Action issued for related U.S. Appl. No. 13/410,831, dated Nov. 6, 2012 (46 pgs).
Office Action issued for related U.S. Appl. No. 13/546,918, dated Sep. 26, 2012 (26 pgs).
Office Action issued for U.S. Appl. No. 12/355,734, dated Apr. 6, 2012 (36 pgs).
Office Action issued for U.S. Appl. No. 12/973,109, dated Apr. 30, 2012 (24 pgs).
Office Action issued in U.S. Appl. No. 14/094,382, dated Mar. 24, 2015 (16 pgs).
Office Action issued in U.S. Appl. No. 14/325,134, dated Apr. 1, 2015 (46 pgs).
Office Action issued in related U.S. Appl. No. 08/418,018, dated Jul. 25, 1997 (6 pgs).
Office Action issued in related U.S. Appl. No. 08/418,018, dated Jan. 17, 1997 (11 pgs).
Office Action issued in related U.S. Appl. No. 08/959,109, dated May 25, 2012 (4 pgs).
Office Action issued in related U.S. Appl. No. 08/959,109, dated Aug. 5, 2011 (7 pgs).
Office Action issued in related U.S. Appl. No. 08/959,109, dated Apr. 1, 2011 (8 pgs).
Office Action issued in related U.S. Appl. No. 08/959,109, dated Jan. 26, 1998 (9 pgs).
Office Action issued in related U.S. Appl. No. 13/141,977, dated Aug. 1, 2013 (37 pgs).
Office Action issued in related U.S. Appl. No. 13/141,977, dated Oct. 11, 2012 (35 pgs).
Office Action issued in related U.S. Appl. No. 13/141,983, dated Oct. 22, 2013 (47 pgs).
Office Action issued in related U.S. Appl. No. 13/410,831, dated Jul. 12, 2013 (7 pgs).
Office Action issued in related U.S. Appl. No. 13/529,914, dated Sep. 27, 2013 (18 pgs).
Office Action issued in related U.S. Appl. No. 13/545,871, dated Aug. 6, 2013 (39 pgs).
Office Action issued in related U.S. Appl. No. 13/546,918, dated May 8, 2014 (22 pgs).
Office Action issued in related U.S. Appl. No. 13/546,918, dated Dec. 5, 2013 (23 pgs).
Office Action issued in related U.S. Appl. No. 14/094,382, dated Aug. 5, 2014 (47 pgs).
Office Action issued in related U.S. Appl. No. 14/094,382, dated Dec. 26, 2014 (25 pgs).
Office Action issued in related U.S. Appl. No. 08/959,109, dated Nov. 21, 2012 (24 pgs).
Office Action issued in related U.S. Appl. No. 08/959,109, dated Apr. 23, 2013 (10 pgs).
Office Action issued in related U.S. Appl. No. 12/973,109, dated Jan. 28, 2013 (19 pgs).
Office Action issued in related U.S. Appl. No. 13/141,977, dated May 8, 2013 (34 pgs).

(56) References Cited

OTHER PUBLICATIONS

Office Action issued in related U.S. Appl. No. 13/141,977, dated May 28, 2015 (88 pgs).
Office Action issued in related U.S. Appl. No. 13/141,983, dated Jun. 14, 2013 (68 pgs).
Office Action issued in related U.S. Appl. No. 13/410,831 dated Feb. 12, 2013 (20 pgs).
Office Action issued in related U.S. Appl. No. 13/410,831, dated May 28, 2013 (15 pgs).
Office Action issued in related U.S. Appl. No. 13/529,914, dated Jun. 21, 2013 (33 pgs).
Office Action issued in related U.S. Appl. No. 13/545,871, dated Nov. 28, 2012 (30 pgs).
Office Action issued in related U.S. Appl. No. 13/545,871, dated Dec. 28, 2012 (7 pgs).
Office Action issued in related U.S. Appl. No. 13/545,871, dated Apr. 12, 2013 (16 pgs).
Office Action issued in related U.S. Appl. No. 13/546,918, dated Apr. 15, 2013 (21 pgs).
Office Action, dated Apr. 11, 2011 in U.S. Appl. No. 12/095,914 (3 pgs).
Office Action, dated Jun. 29, 2011 in U.S. Appl. No. 12/059,909 (21 pgs).
Office Action, dated Jul. 27, 2011 in U.S. Appl. No. 12/059,909 (34 pgs).
Office Action, dated Sep. 14, 2011 in U.S. Appl. No. 12/430,733 (7 pgs).
Office Action, dated Sep. 15, 2011 in U.S. Appl. No. 12/355,740 (6 pgs).
Office Action, dated Dec. 7, 2011 in U.S. Appl. No. 12/355,734 (31 pgs).
Office Action, dated Dec. 13, 2011 in U.S. Appl. No. 12/973,109 (27 pgs).
Office Action, dated Dec. 20, 2011 in U.S. Appl. No. 12/355,740 (12 pgs).
Remedios et al., "NFC Technologies in Mobile Phones and Emerging Applications," 2006, IFIP International Federation for Information Processing, vol. 220, Information Technology for Balanced Manufacturing Systems, ed. Shen, W., (Boston: Springer, pp. 425-434 (10 pgs).
Request for Continued Examination (RCE) and Information Disclosure Statement by Applicant filed for U.S. Appl. No. 12/973,109 on May 31, 2012 (43 pgs).
Request for Continued Examination, dated Mar. 30, 2012 in U.S. Appl. No. 12/355,734 (32 pgs).
Request for Continued Examination, dated Sep. 27, 2011 in U.S. Appl. No. 12/059,909 (18 pgs).
Shaheen, S., "Smart Parking Management Field Test: A Bay Area Rapid Transit (BART) District Parking Demonstration," Institute of Transportation Studies, UC Davis, Jan. 1, 2005 (139 pgs).
Supplementary European Search Report issued in related application No. EP07784953, dated Jul. 1, 2010 (1 pg).
The United States Conference of Mayors Press Release, "The U.S. Conference of Mayors Presents 'Best-Practice' Awards," Jan. 20, 2012, (3 pgs).
Office Action issued in U.S. Appl. No. 14/325,134, dated Jul. 21, 2015 (28 pgs).
Bridge IR Group, Inc., Changing the Way the World Pays for On-Street Parking, Research Report, United States—Technology Processing Systems/Products, Dec. 6, 2006 (23 pgs).
Canadian Office Action issued in application No. 2,870,544, dated Oct. 15, 2015 (6 pgs).
IPS Multi Bay Parking Meter product description, http://www.design-industry.com.au/work/multi-bay-parking-meter/, Oct. 6, 2015 (6 pgs).
IPS Single Bay Parking Meter product description, http://www.design-industry.com.au/work/ips-single-parking-meter/, Oct. 6, 2015 (6 pgs).
Photo Violation Technologies—Revolutionizing the Industry by Perfecting How People Park, https://web.archive.org/web/20060813094459/http://photoviolation.com/, Aug. 13, 2006 (65 pgs).
Photo Violation Technologies—Revolutionizing the Industry by Perfecting How People Park, https://web.archive.org/web/20060823100739/http://photoviolation.com/, Aug. 23, 2006 (65 pgs).
Photo Violation Technologies—Revolutionizing the Industry by Perfecting How People Park, https://web.archive.org/web/20080222104246/http://photoviolation.com/, Feb. 22, 2008 (47 pgs).
Photo Violation Technologies—Revolutionizing the Industry by Perfecting How People Park, https://web.archive.org/web/20060110041849/http://photoviolation.com/, Jan. 10, 2006 (57 pgs).
Photo Violation Technologies—Revolutionizing the Industry by Perfecting How People Park, http://web.archive.org/web/20060715195511/http://photoviolation.com/, Jul. 15, 2006 (49 pgs).
Photo Violation Technologies Corp. Press Releases, Jul. 18, 2005-Jan. 17, 2006 (9 pgs).
Photo Violation Technologies Corp., https://web.archive.org/web/2013118213440/http://photoviolationmeter.com/, Nov. 18, 2013 (8 pgs).
Photo Violation Technologies Corp., https://web.archive.org/web/20040401225217/http://photoviolationmeter.com/, Apr. 1, 2004 (50 pgs).
The PhotoViolationMeter Case Study, Photo Violation Technologies Corp., Dec. 15, 2015 (4 pgs).
YouTube video, "The PhotoViolationMeter TM" https://www.youtube.com/watch?v=YEFuebnwn_Y, Dec. 15, 2006 (2 pgs).
Transcript & Screenshots of http://web.archive.org/web/20080222104246/http://www.photoviolation.com/videos/HHU.wmv, Photo Violation Technologies Corp.—"PhotoViolationHandHeldUnit™," dated prior to Jun. 15, 2015 (7 pgs).
Transcript & Screenshots of https:web.archive.org/web/20080222104246/http://www.photoviolation.com/videos/PBS.wmv, Photo Violation Technologies Corp.—"The PBS Solution," dated prior to Jun. 15, 2015 (10 pgs).
Digital Payment Technologies, Credit Card Processing with LUKE and SHELBY, Dec. 2007 (15 pgs).
Digital Payment Technologies, Digital Payment Technologies and PXT Payments Forge Partnership to Bring Cities Smart Parking Meters and Merchant Loyalty Debit Cards, www.digitalpaytech.com, Apr. 27, 2010 (2 pgs).
Digital Payment Technologies, Request for Proposal #B09030—Parking Pay Stations, City of Dover, New Hampshire, Oct. 22, 2008 (part 1—110 pgs).
Digital Payment Technologies, Request for Proposal #B09030—Parking Pay Stations, City of Dover, New Hampshire, Oct. 22, 2008 (part 2—160 pgs).
Digital Payment Technologies, Request for Proposal for Multi-Space Parking Meters, City of Fort Lauderdale, Jan. 13, 2010 (89 pgs).
Digital Payment Technologies, Sierra Wireless Case Study, Dec. 7, 2009(2 pgs).
Digital Payment Technologies, Technologies Launches LUKE II Multi-Space Parking Pay Station, May 16, 2011 (3 pgs).
*Duncan Parking Technologies, Inc.* v. *IPS Group Inc.*, Case IPR2016-00068, Decision, Mar. 30, 2016 (13 pgs).
*Duncan Parking Technologies, Inc.* v. *IPS Group Inc.*, Case IPR2016-00070, Decision, Apr. 1, 2016 (17 pgs).
*Duncan Parking Technologies, Inc.* v. *IPS Group Inc.*, Case 1PR2016-00069, Decision, Apr. 1, 2016 (13 pgs).
*Duncan Parking Technologies, Inc.* v. *IPS Group Inc.*, Case IPR2016-00067, Decision, Mar. 30, 2016 (19 pgs).
*Duncan Parking Technologies, Inc.* v. *IPS Group Inc.*, Case IPR2016-00067, Preliminary Response, Jan. 29, 2016 (38 pgs).
*Duncan Parking Technologies, Inc.* v. *IPS Group Inc.*, Case IPR2016-00068, Patent Owner's Preliminary Response, Feb. 1, 2016 (48 pgs).

(56) References Cited

OTHER PUBLICATIONS

*Duncan Parking Technologies, Inc.* v. *IPS Group Inc.*, Case IPR2016-00069, Patent Owner's Preliminary Response, Feb. 1, 2016 (48 pgs).
*Duncan Parking Technologies, Inc.* v. *IPS Group Inc.*, Case IPR2016-00070, Preliminary Response, Feb. 1, 2016 (49 pgs).
*Duncan Parking Technologies, Inc.* v. *IPS Group Inc.*, Case IPR2016-00067, Patent Owner's Mandatory Notices, Nov. 6, 2015 (4 pgs).
*Duncan Parking Technologies, Inc.* v. *IPS Group Inc.*, Case IPR2016-00067, Scheduling Order, Mar. 30, 2016 (9 pgs).
Duncan Solutions, AutoCITE™ X3 Handheld Computer, 2013 (2 pgs).
Duncan Solutions, Duncan VS, 2006 (2 pgs).
Duncan Solutions, Pay-by-Space Parking Meters, Customer Support Manual, Jul. 2006 (part 1—113 pgs).
Duncan Solutions, Pay-by-Space Parking Meters, Customer Support Manual, Jul. 2006 (part 2—103 pgs).
Duncan Solutions/Reino, RSV3 Digital Parking Meter, Jul. 5, 2011 (2 pgs).
Duncan, Duncan VM-Solar Power meter photograph, pre-Mar. 2011 (1 pg).
International Search Report issued in application No. PCT/US2013/021201, dated Apr. 30, 2013 (3 pgs).
Intrinsync Software International, Inc., Intrinsyc and Digital Pioneer Partner on Development of New Leading Edge Parking Terminal Solution, Aug. 14, 2003 (2 pgs).
IPS Group Inc., Exhibit 2001, Design of an advanced on-street parking meter, Jan. 12, 2016 (2 pgs).
IPS Group Inc., Exhibit 2002, About RIT Digital Media Library, Jan. 12, 2016 (1 pg).
IPS Group Inc., Exhibit 2003, The U.S. Conference of Mayors Presents 'Best-Practice' Awards, Jan. 20, 2012 (2 pgs).
IPS Group Inc., Exhibit 2004, City of Los Angeles, Card & Coin Parking Meter Lease, Nov. 29, 2010 (4 pgs).
IPS Group Inc., Exhibit 2005, City of Culver City, California, Approval of a Contract with IPS Group Inc., for the Sole-Source Purchase of 1,000 Parking Meters, Dec. 12, 2011 (3 pgs).
IPS Group Inc., Exhibit 2006, City of San Luis Obispo City Manager Report, Award of Credit Card Meters and Service Contract, RFP Specification No. 91137, Jan. 20, 2012 (5 pgs).
IPS Group Inc., Exhibit 2007, Walnut Creek, Alternate Downtown Parking Pay Technology, Oct. 20, 2011 (4 pgs).
IPS Group Inc., Exhibit 2008, How M2M Maximizes Denver's Revenue, Oct. 2011 (4 pgs).
IPS Group Inc., Exhibit 2009, Somerville, MA, T&P Introduces User-Friendly Parking Meters & Service Upgrades with Electronic Meter Pilot, Apr. 19, 2011 (2 pgs).
Kienzle, meter photograph, pre-Mar. 2011 (1 pg).
Notice of Allowance issued in U.S. Appl. No. 13/546,918, dated Mar. 28, 2016 (29 pgs).
Notice of Allowance issued in U.S. Appl. No. 14/325,134, dated Apr. 28, 2016 (19 pgs).
Notice of Allowance issued in U.S. Appl. No. 14/743,691, dated May 13, 2016 (62 pgs).
Office Action issued in U.S. Appl. No. 29/477,176, dated May 4, 2015 (16 pgs).
Office Action issued in U.S. Appl. No. 29/477,200, dated Apr. 9, 2015 (13 pgs).
Office Action issued in U.S. Appl. No. 29/477,201, dated Apr. 9, 2015 (11 pgs).
Office Action issued in U.S. Appl. No. 29/477,204, dated Apr. 9, 2015 (13 pgs).
Office Action issued in U.S. Appl. No. 29/477,402, dated Apr. 9, 2015 (19 pgs).
Reino International, Recommended Cashbox Handling Guidelines, Version 2.0, Nov. 26, 2003 (7 pgs).
Reino Meter Advertisement, The power of a paystation, Parking Today, Aug. 2003 (1 pg).
Reino Parking Systems: On-Street Service Procedures, Jun. 29, 2004 (19 pgs).
Reino, Operator User Manual, 2003 (106 pgs).
Reino, Parking Systems RSV2 Service Manual, Version 3.1, Dec. 2003 (78 pgs).
Reino, RSV3 brochure, Nov. 10, 2007 (4 pgs).
*Duncan Parking Technologies, Inc.* vs. *IPS Group Inc.*, Patent Owner's Preliminary Response, Case IPR2016-01144, dated Sep. 8, 2016 (58 pgs).
*Duncan Parking Technologies, Inc.* vs. *IPS Group Inc.*, Patent Owner's Preliminary Response, Case IPR2016-01145, dated Sep. 8, 2016 (52 pgs).
*Duncan Parking Technologies, Inc.* vs. *IPS Group Inc.*, Patent Owner Response, Case IPR2016-00067, dated Jul. 12, 2016 (32 pgs).
U.S. Appl. No. 10/317,414, filed Dec. 12, 2002.
U.S. Appl. No. 12/788,100, filed May 26, 2010.
U.S. Appl. No. 13/454,976, filed Apr. 24, 2012.
U.S. Appl. No. 29/367,429, filed Aug. 6, 2010.
U.S. Appl. No. 29/367,431, filed Aug. 6, 2010.
U.S. Appl. No. 29/391,605, filed May 11, 2011.
U.S. Appl. No. 29/410,857, filed Jan. 12, 2012.
U.S. Appl. No. 61/048,133, filed Apr. 25, 2008.
U.S. Appl. No. 61/140,543, filed Dec. 23, 2008.
U.S. Appl. No. 13/782,818, filed Mar. 1, 2013.
U.S. Appl. No. 15/220,228, filed Jul. 26, 2011.
U.S. Appl. No. 15/348,785, filed Nov. 10, 2016.
Office Action issued in U.S. Appl. No. 14/743,691, dated May 13, 2016 (62 pgs).
The Patented PhotoViolationMeter Solution book view, dated Mar. 28, 2006 (12 pgs).
Transcript & Screenshots of https://web.archive.org/web/20080222104246/http://www.photoviolation.com/videos/PCM.wmv, Photo Violation Technologies Corp.—"ParkCardMeter™ System," dated prior to Jun. 15, 2015 (6 pgs).
Transcript & Screenshots of https://web.archive.org/web/20080222104246/http://www.photoviolation.com/videos/HHU.wmv, Photo Violation Technologies Corp.—"PhotoViolationHandHeldUnit™," dated prior to Jun. 15, 2015 (7 pgs).
Transcript & Screenshots of https://web.archive.org/web/20080222104246/http://www.photoviolation.com/videos/PBS.wmv, Photo Violation Technologies Corp.—"The PBS Solution," dated prior to Jun. 15, 2015 (10 pgs).
Transcript & Screenshots of https://web.archive.org/web/20080222104246/http://www.photoviolation.com/videos/PVM.wmv, Photo Violation Technologies Corp.—"The PVM Solution," dated prior to Jun. 15, 2015 (17 pgs).
Design U.S. Appl. No. 29/466,268, filed Sep. 5, 2013 (19 pgs).
Design U.S. Appl. No. 29/466,267, filed Sep. 5, 2013 (19 pgs).
Design U.S. Appl. No. 29/466,269, filed Sep. 5, 2013 (19 pgs).
Design U.S. Appl. No. 29/477,176, filed Dec. 19, 2013 (24 pgs).
Design U.S. Appl. No. 29/477,195, filed Dec. 19, 2013 (21 pgs).
Design U.S. Appl. No. 29/477,196, filed Dec. 19, 2013 (21 pgs).
Design U.S. Appl. No. 29/477,339, filed Dec. 20, 2013 (21 pgs).
Design U.S. Appl. No. 29/477,402, filed Dec. 20, 2013 (24 pgs).
Design U.S. Appl. No. 29/477,405, filed Dec. 20, 2013 (24 pgs).
Video link, "ParkCardMeter™ System," https://web.archive.org/web/20080222104246/http://www.photoviolation.com/videos/PCM.wmv, Photo Violation Technologies Corp., dated prior to Jun. 15, 2015.
Video link, "PhotoViolationHandHeldUnit™," https://web.archive.org/web/20080222104246/http://www.photoviolation.com/videos/HHU.wmv, Photo Violation Technologies Corp., dated prior to Jun. 15, 2015.
Video link, "The PBS Solution," https://web.archive.org/web/20080222104246/http://www.photoviolation.com/videos/PBS.wmv, Photo Violation Technologies Corp., dated prior to Jun. 15, 2015.
Video link, "The PVM Solution," https://web.archive.org/web/20080222104246/http://www.photoviolation.com/videos/PVM.wmv, Photo Violation Technologies Corp., dated prior to Jun. 15, 2015.

(56) References Cited

OTHER PUBLICATIONS

Office Action issued in U.S. Appl. No. 14/864,170, dated Oct. 7, 2016 (65 pgs).
Cardinal Tracking Inc.—MobileCite brochure, dated prior to Jun. 15, 2015 (2 pgs).
Digital Payment Technologies—LUKE brochure, dated prior to Jun. 15, 2015 (4 pgs).
*Duncan Parking Technologies, Inc.* vs. *IPS Group Inc.*, Patent Owner's Preliminary Response, dated Sep. 8, 2016 (58 pgs).
*Duncan Parking Technologies, Inc.* vs. *IPS Group Inc.*, Patent Owner's Preliminary Response, dated Sep. 8, 2016 (52 pgs).
*Duncan Parking Technologies, Inc.* vs. *IPS Group Inc.*, Patent Owner Response, dated Jul. 12, 2016 (32 pgs).
*Duncan Parking Technologies, Inc.* vs. *IPS Group Inc.*, Petition for Inter Partes Review, U.S. Pat. No. 8,595,054, dated Jun. 3, 2016 (79 pgs).
*Duncan Parking Technologies, Inc.* vs. *IPS Group Inc.*, Petition for Inter Partes Review, U.S. Pat. No. 7,854,310, dated Jun. 3, 2016 (70 pgs).
Notice of Allowance issued in U.S. Appl. No. 13/141,977, dated Jul. 29, 2016 (62 pgs).
Office Action issued in U.S. Appl. No. 14/743,691, dated Sep. 2, 2016 (26 pgs).
PhotoViolationMeter pamphlet, dated Jan. 18, 2006 (2 pgs).
POM APM photographs, dated Apr. 29, 2010 (33 pgs).
POM APM Solar Powered Meter advertisements, dated Apr. 28, 2010 (5 pgs).
StreetSmart Technology, LLC, "Technical Specifications and System Features for the StreetSmart Solution" Brochure, May 2011 (8 pgs).

* cited by examiner

COIN CHUTE WITH ANTI-FISHING ASSEMBLY

TECHNICAL FIELD

The current application relates to coin chutes, and in particular to coin chutes that impede the fishing of coins.

BACKGROUND

Devices and machines that accept coins for payment, such as parking meters and vending machines, are typically unattended and located in public areas. As such, they are sometimes the subject of vandalism, and theft of, for example, either the parking meter itself or the coins used to pay for parking. With respect to parking meters, they generally include a coin chute into which coins are inserted. As the coin passes through the coin chute it may pass an arrangement of one or more sensors, typically inductive coils that can discriminate the value of the coin. When a coin passes through such a coin discriminator comprising discrimination sensors in the meter it travels from the upper portion of the parking meter housing and enters into a coin canister located in a lower vault, which is secured against theft by way of a hardened and locked housing.

Some coin chutes have an anti-pull back device (or assembly) that prevents or impedes coins from being pulled back and out of the coin chute. For example, pulling a coin back and out of the coin chute may be done by using a string fastened to the coin, and then pulling the coin out of the chute after the coin has fallen down the coin chute and been detected by the discrimination sensors. By employing an anti-pull back device, the same coin is prevented from being pulled back up the chute. This in turn prevents the same coin from passing through the discrimination sensors multiple times in order to receive credit for paid parking time without having deposited the required amount of coins. These anti-pull back devices can be found both in the meter, as well as at the entrance to the coin canister located in the lower vault area. The anti-pull back devices may be mechanical and may include a plurality of hinged fingers crossing the coin path. When the coin travels down the coin chute, the fingers may rotate out of the way. However, when the coin is attempted to be retrieved and pulled back up the coin chute, the fingers may be prevented from rotating out of the way.

While anti-pull back devices can prevent or impede pulling back the same coin in order to be counted numerous times, they may not prevent or impede all types of schemes to defraud a parking authority, or the public, of money. For example, a vandal or thief may force a foreign object into the coin chute in order to cause a jam in the coin chute, such as a jam just above the anti-pull back device that is located further down the coin chute. The foreign object may be non-metallic so that it may not be detected by sensors in the coin chute, which results in the parking meter remaining in service. When an unsuspecting customer attempts to make a payment, the inserted coins will remain in the coin chute instead of passing into the coin vault area. The thief or vandal may then attempt to fish out the inserted coins that are still in the coin chute.

An improved, additional or alternative coin chute that can impede the fishing of inserted coins from the coin chute is desirable.

SUMMARY

In accordance with the present disclosure, there is provided a coin chute for use in a vending machine comprising:

a coin channel defined by a first sidewall and a second sidewall opposite the first sidewall, the channel having a first portion through which coins may be inserted into the coin chute, and a second portion through which coins exit the channel; a coin discriminator for determining a denomination of coin passing the discriminator; and a first anti-fishing assembly located between the first portion of the channel and the coin discriminator comprising an anti-fishing finger rotatable between a first position in which the anti-fishing finger extends across the channel and a second position in which the anti-fishing finger is rotated out of the channel.

In an embodiment, the coin chute further comprises a second anti-fishing assembly located between the first portion of the channel and the coin discriminator comprising a rotatable anti-fishing finger.

In a further embodiment of the coin chute, the first anti-fishing assembly and the second anti-fishing assembly are offset horizontally from each other in the channel.

In a further embodiment of the coin chute, the first anti-fishing assembly and the second anti-fishing assembly are offset vertically from each other in the channel.

In a further embodiment of the coin chute, the first anti-fishing assembly and the second anti-fishing assembly are both located on a same one of the first or second sidewalls.

In a further embodiment of the coin chute, the first anti-fishing assembly and the second anti-fishing assembly are located on different ones of the first or second sidewalls.

In a further embodiment of the coin chute, the second anti-fishing assembly comprises a plurality anti-fishing fingers.

In a further embodiment of the coin chute, each of the plurality of anti-fishing fingers of the second anti-fishing assembly are independently rotatable.

In a further embodiment of the coin chute, the first anti-fishing assembly comprises a plurality of independently rotatable anti-fishing fingers spaced apart from each other by a first amount, and the second anti-fishing assembly comprises a plurality of independently rotatable anti-fishing fingers spaced apart from each other by a second amount different from the first amount.

In a further embodiment of the coin chute, each of the first anti-fishing assembly and the second anti-fishing assembly comprise an assembly frame securable to a coin chute frame, an axle secured between the assembly frame and the coin chute frame, wherein respective anti-fishing fingers are rotatably connected to the axle.

In a further embodiment of the coin chute, the first anti-fishing assembly and the second anti-fishing assembly are received within corresponding recesses within one of the first or second sidewalls.

In a further embodiment of the coin chute, first anti-fishing assembly is located adjacent and immediately below the first portion of the channel through which coins may be inserted.

In a further embodiment of the coin chute, the second anti-fishing assembly is located on an opposite side of the channel from the first portion of the channel through which coins may be inserted and at least partially above the first anti-fishing assembly.

In a further embodiment, the coin chute further comprises an anti-pull back assembly located between the second portion of the channel and the coin discriminator comprising an anti-pull back finger rotatable between a first position in which the anti-pull back finger extends across the channel and a second position in which the anti-pull back finger is rotated out of the channel, wherein the anti-pull back finger is biased to the first position.

In a further embodiment of the coin chute, the anti-pull back assembly comprises a plurality of rotatable anti-pull back fingers.

In a further embodiment of the coin chute, at least one of the plurality of anti-pull back fingers is connected to the first sidewall and at least one of the plurality of anti-pull back fingers is connected to the second sidewall.

In a further embodiment of the coin chute, the first sidewall and second sidewall are connected to each other by one or more of: a snap-fit; an adhesive; and mechanical fasteners.

In a further embodiment of the coin chute, the coin channel comprises a third portion at an end of the channel opposite the second portion, and wherein said third portion comprises an opening for at least partially inspecting the coin channel.

In a further embodiment, the coin chute further comprises a housing at least partially surrounding at least the coin channel, coin discriminator and first anti-fishing assembly.

In a further embodiment of the coin chute, the housing comprises a cut-out to allow rotation of the anti-fishing finger of the first anti-fishing assembly.

In a further embodiment of the coin chute, the anti-fishing finger of the first anti-fishing assembly is coloured black or is a dark colour.

In a further embodiment of the coin chute, the plurality of anti-fishing fingers of the second anti-fishing assembly are coloured black or are a dark colour.

In a further embodiment of the coin chute, the plurality of anti-fishing fingers of the first anti-fishing assembly and the plurality of anti-fishing fingers of the second anti-fishing assembly are coloured black or are a dark colour.

In a further embodiment of the coin chute, the anti-fishing finger of the first anti-fishing assembly is not visible or is of reduced or limited visibility to a person at least horizontally peering into the coin chute at the first portion.

In a further embodiment of the coin chute, the plurality of anti-fishing fingers of the second anti-fishing assembly are not visible or are of reduced or limited visibility to a person at least horizontally peering into the coin chute at the first portion.

In a further embodiment of the coin chute, the plurality of anti-fishing fingers of the first anti-fishing assembly and the plurality of anti-fishing fingers of the second anti-fishing assembly are not visible or are of reduced or limited visibility to a person at least horizontally peering into the coin chute at the first portion.

In a further embodiment of the coin chute, the coin channel comprises an insert or filler that restricts or narrows the width of the coin channel.

In a further embodiment of the coin chute, the coin channel is restricted or narrowed such that the coin channel is only able to accommodate the width of one high value coin.

In a further embodiment of the coin chute, at least in part the insert or filler occupies a space extending from the first portion to the first anti-fishing device.

In accordance with the present disclosure, there is further provided a vending machine comprising: components for metering the sale of goods or services; and a coin chute as described herein.

In an embodiment of the vending machine, the goods or services metered comprises parking time for a parking space.

BRIEF DESCRIPTION OF THE DRAWINGS

Further features and advantages of the present disclosure will become apparent from the following detailed description, taken in combination with the appended drawings, in which.

DETAILED DESCRIPTION

A parking meter that incorporates a coin chute including an anti-fishing assembly or anti-fishing device may impede withdrawal of coins from a coin chute. As described further herein, the anti-fishing assembly (or device, as referred to interchangeably herein) may be incorporated into a coin chute during manufacture. The anti-fishing assembly may be incorporated into the coin chute in addition to an anti-pull back assembly that prevents or impedes a coin from being pulled back past a coin discriminator a plurality of times. As described further below, the anti-fishing assembly provides an obstacle in a coin channel that impedes fishing coins from the coin channel as well as reduces the number of coins that can be held within the coin channel. As described further below, the anti-fishing assembly comprises at least one anti-fishing finger that is located within an upper section of the coin channel.

Figure 1:
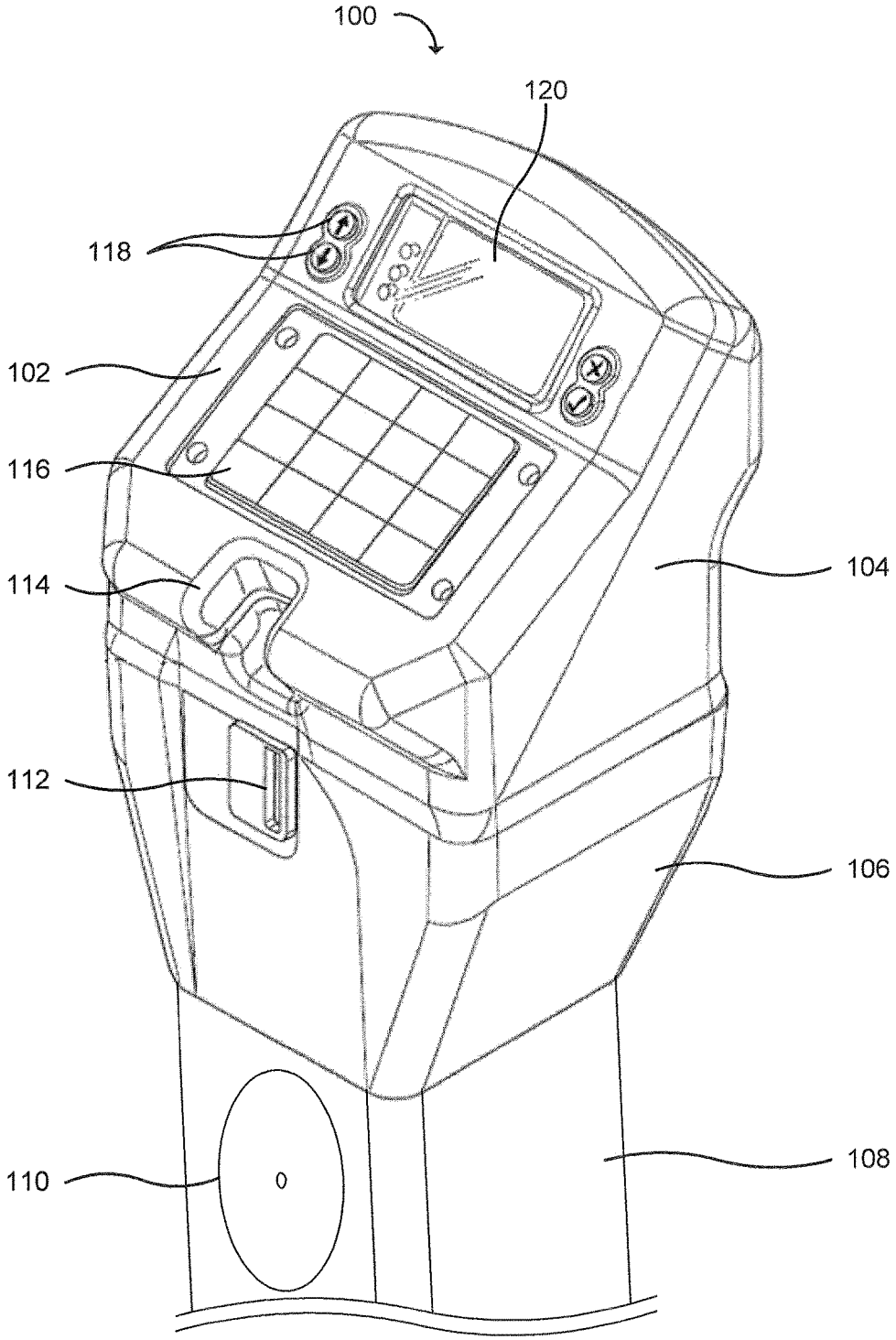
FIG. 1 depicts a parking meter having a coin chute with an anti-fishing assembly.

FIG. 1 depicts a parking meter which incorporates a coin chute with an anti-fishing assembly in accordance with the present disclosure. The parking meter 100 is a single space parking meter. Although parking meter 100 is referred to as a single space parking meter, it may actually meter parking time for two or more parking spaces. Single space parking meters may comprise a removable parking meter mechanism 102 which is housed within a housing for the upper portion of the parking meter. As depicted in FIG. 1, the housing may comprise a back housing 104 and a lower housing 106. The lower housing 106 may be attached to a coin vault 108 that may be typically installed on a pole near a parking location associated with the meter 100. The coin vault 108 may include a coin canister and a vault door 110 that can be locked to prevent unauthorized access to coins being stored in the vault 108. The coins may be inserted into the parking meter through a coin slot 112 in the housing of the parking meter mechanism 102. The coin enters a coin channel of a coin chute where a coin discriminator comprising sensor circuitry can determine the denomination of the inserted coin. In order to prevent or impede withdrawal of inserted coins, anti-fishing assemblies as well as anti-pull back assemblies may be incorporated into the coin chute.

The anti-fishing assemblies and anti-pull back assemblies are similar in purpose, namely to prevent or impede the withdrawal of inserted coins; however, each of the assemblies are directed to defeating different types of attacks. The anti-pull back assemblies prevent or impede inserted coins from being pulled back past the coin discrimination circuitry to have a single inserted coin counted multiple times. The anti-fishing assemblies of the present invention prevent inserted coins from being withdrawn from the coin channel, even if they have not passed the coin discrimination circuitry. Additionally, the anti-fishing assemblies of the present invention reduce or at least somewhat minimize the volume in the coin channel within which coins can rest in the event of a blockage within the coin channel, and as such reduce the number of coins that could potentially be fished out. As an example, a coin chute having only anti-fishing assemblies may be susceptible to time theft by inserting a coin on a string and repeatedly pulling the coin back past the discrimination circuitry. Although the anti-fishing assemblies may prevent the inserted coin from being retrieved, the coin may be counted multiple times and as such a single coin such as a nickel or dime may be used to pay for a dollar, two dollars or more of parking time. While the anti-pull back assemblies may prevent such types of attack, if there is a blockage in the chute, coins may accumulate in the coin channel by resting on top of the blockage. These accumulated coins may then be fished out of the coin channel; the anti-pull back assemblies do not provide any deterrent to such an attack.

In addition, the removable parking meter mechanism 102 may comprise alternative payment means such as a card payment means 114. The parking meter mechanism 102 may include a solar panel 116 for charging a battery pack of the mechanism. The parking meter mechanism 102 may also include one or more input controls 118 for controlling operation of the meter mechanism, as well as a display 120 for displaying an amount of parking time purchased.

Figure 2:
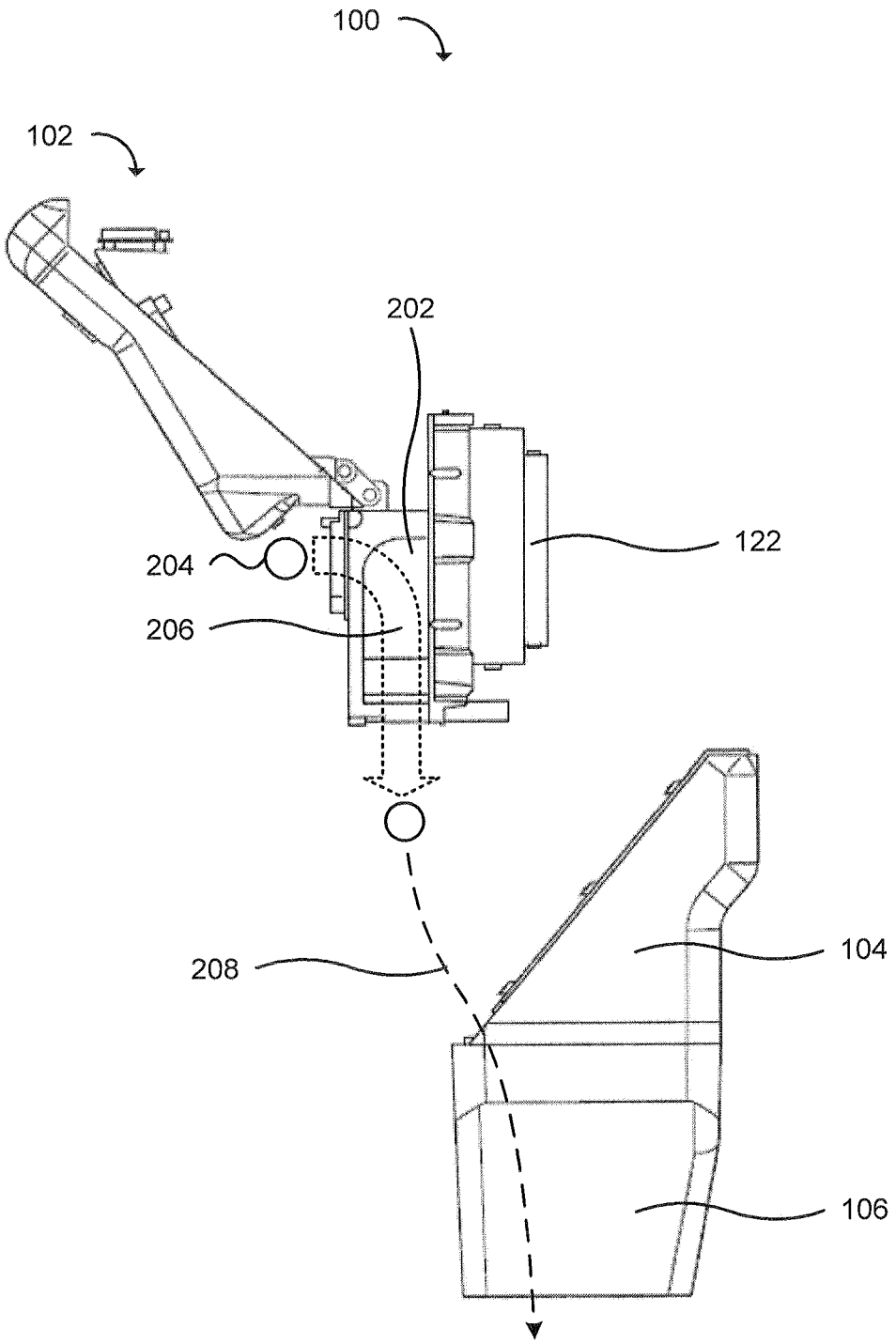
FIG. 2 depicts a partially disassembled view of the parking meter 100 of FIG. 1.

FIG. 2 depicts a disassembled view of the parking meter 100 of FIG. 1. As depicted, the removable parking meter mechanism 102 can be removed from the back housing 104 and the lower housing 106. The coin vault is not depicted in FIG. 2; however, it would be attached to the bottom of the lower housing 106. The removable parking meter mechanism 102 includes components for metering a parking spot, or spots. The metering components may include a display and control components as well as electronics for controlling the operation of the parking meter. The removable parking meter mechanism may include a battery pack 122 for powering the components of the removable parking meter mechanism 102. The removable parking meter mechanism 102 further comprises a coin chute 202 that includes a coin channel that allows a coin inserted into the coin slot of the parking meter to pass through a sensor, or sensors, that can discriminate the denomination of the inserted coin. A coin 204 that is inserted into the coin slot of the parking meter enters the coin channel and passes through the coin chute 202, as depicted by arrow 206. When the parking meter is assembled, as shown in FIG. 1, the coin 204 passes through the coin channel in the direction of arrow 206 and into the coin vault, as depicted by dashed line 208. The inserted coin passes through the coin chute by an anti-fishing assembly, a coin discriminator comprising circuitry and/or sensor(s), and possibly an anti-pull back assembly.

Although not depicted, multi-space parking meters often have a number of the same components as the single space parking meter 100 of FIGS. 1 and 2, including a housing, a display, a coin chute, a vault, a card payment means, a solar panel, and battery pack components. Multi-space parking meters differ from single space parking meters in that the multi-space meters are typically larger devices capable of managing parking payment and control for typically significantly more than one or two parking spaces and possibly as many as hundreds of parking spaces. Notwithstanding any differences, multi-space parking meters may incorporate a coin chute with an anti-fishing assembly in accordance with the present disclosure. Further, the coin chute described herein may be used in not only parking meters, but also vending machines more generally, including for example single and multi-space parking meters, food and/or beverage vending machines, toy vending machines, electronics vending machines, as well as other vending machines that accept payment for a good or service in coins or tokens.

A thief wishing to defraud a parking authority may do so in a number of different types of attacks. For example, a thief may place a coin attached to a string into the coin chute. Once the coin passes the coin discriminator, the thief can pull the coin up past or above the coin discriminator, and then allow the coin to be lowered and pass through the discriminator again. In order to prevent this type of theft, the coin chute 202 may include an anti-pull back assembly that prevents a coin 204 from being pulled up the coin chute once it has passed the coin discriminator. In addition, if the coin travels into the coin canister in the vault area, the coin canister may also have built-in anti-pull back levers that will trap the coin inside the coin canister. The anti-pull back assembly may comprise a number of moveable fingers that are pivoted out of the path of a downward-moving coin by the downward force of the coin, but are prevented from pivoting out of the coin path when the coin is pulled upwards. Although the anti-pull back device can prevent a single coin from being counted a plurality of times, other types of fraud are possible. For example, a thief or vandal may insert an object into the coin channel to block the channel. In this situation, when a user inserts a coin, it will enter the coin channel; however, it will not pass the anti-pull back assembly due to the foreign object jam. The inserted coin or coins will remain in the coin channel, and once the user leaves the parking meter, the thief may approach the meter and fish the inserted coins out of the coin channel. The addition of optical sensors incorporated into the coin chute, along with corresponding software, could provide additional detection of jams within the coin channel and place the parking meter into a non-functioning state; however, retrofitting or adding the required optical sensors to the coin chute may not be possible or practical, and may require replacement of the entire coin chute assembly. Moreover, additional sensors and/or software may result in increased power consumption, which is generally undesirable for unattended vending machines, including parking meters, which typically rely upon batteries for power supply.

In order to discourage fishing types of theft, an anti-fishing assembly may be incorporated into the coin chute. The anti-fishing assembly is preferably placed as close as possible to the insertion point of the coin chute but without being visible, or being of reduced or limited visibility, to a person at least horizontally peering into the coin chute at coin slot 112. Placing the anti-fishing assembly as close as possible to the insertion point of the coin chute in this regard reduces or at least somewhat minimizes the volume in the coin channel within which coins can rest in the event of a blockage within the coin channel, and as such reduce the number of coins that could potentially be fished out. As described further herein, the anti-fishing assembly may comprise one or more fingers that extend from a side of the coin channel into the coin channel. The fingers allow a coin to be inserted into the coin channel; however, if the coin is attempted to be withdrawn from the coin channel, the fingers may block the coin from being withdrawn.

Figure 3:
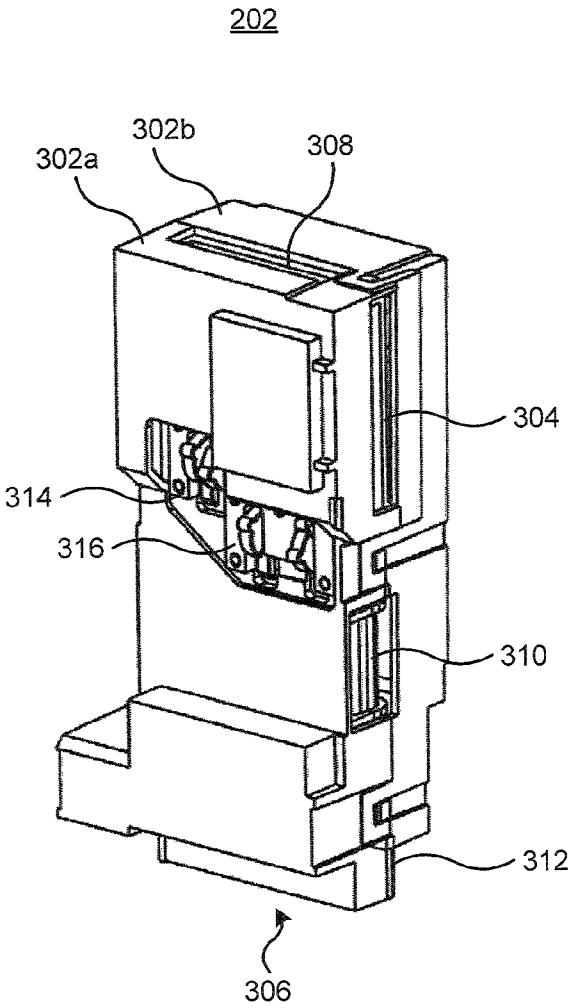
FIG. 3 depicts a coin chute with an anti-fishing assembly used in the parking meter of FIGS. 1 and 2.
Figure 4:
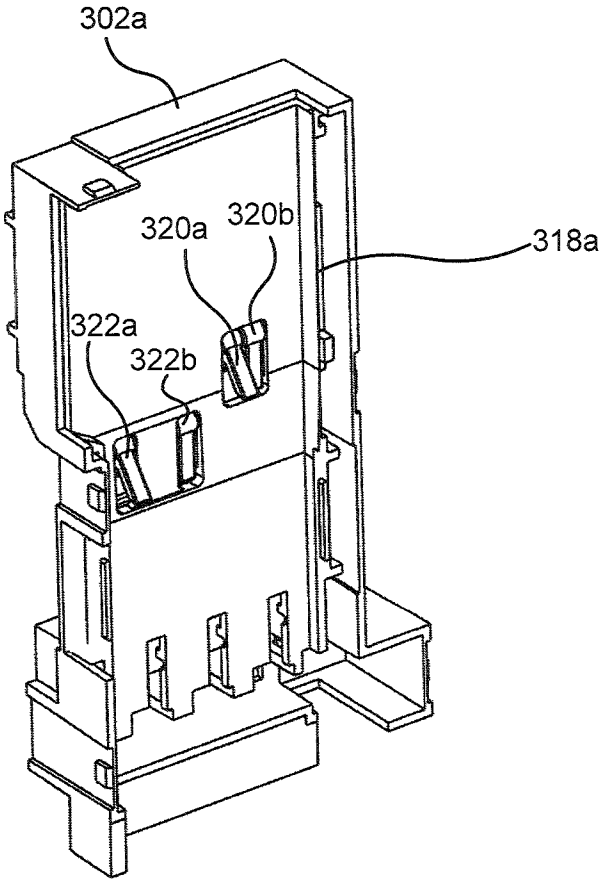
FIG. 4 depicts an interior of a side of the coin chute of FIG. 3.

A coin chute with an anti-fishing assembly used in the parking meter of FIGS. 1 and 2, or more broadly in vending machines in general, is described with particular reference to FIGS. 3-7. As best depicted in FIG. 3, the coin chute 202 may be provided as a modular component that can be incorporated into, for example, parking meters. The coin chute 202 may have an exterior housing, which may be formed from two connected halves 302*a*, 302*b*. The coin chute includes an opening or entrance 304 through which coins can be inserted. The coins enter the coin chute and fall through the coin chute and exit through a bottom 306 of the coin chute. In addition to the coin entrance 304, the coin chute may also include an inspection or maintenance opening 308 that allows the interior coin channel 318 of the coin chute to be visually inspected, as well as facilitation of maintenance such as removing or clearing blockages.

When a coin is inserted into the coin chute, it passes through the opening 304 and into a coin channel. The coin channel 318 may be formed from two connected walls 318*a*, 318*b* (see FIG. 6). The coin falls down the coin channel and passes a coin discriminator comprising one or more discrimination components that can determine a denomination of the coin. The coin chute 202 has a discriminator that comprises two main sections. Although the actual discrimination components are not depicted in the Figures, the locations of the components are shown. The first component of the discriminator is a horizontal coil wound about the coin channel. The coil may be wound about the coin channel to form a loop or rounded section 310 such that coins passing through the coin channel pass through the center of the coil loop. A second component of the discriminator comprises a pair of horizontally aligned coils. The coils may be located on, or supported by, respective ends 312*a*, 312*b* (see FIG. 5) of the coin channel. Regardless of the coin discriminator used, the coin chute 202 may include a number of anti-pull back devices 328*a*, 328*b*, 328*c* (referred to collectively as anti-pull back device 328) that prevent a coin from being pulled up or withdrawn past the coin discriminator, or at least a portion of the coin discriminator such as the horizontal coil loop located at the rounded section 310. The coin chute 202 may include further electronic components. Although not depicted, the components may include, for example, a coin proximity detector comprising a pair of coil loops located at either side 326 of the entrance 304 of the coin chute.

The coin chute 202 includes an anti-fishing device, or anti-fishing devices, 314, 316. Like the anti-pull back devices 328, the anti-fishing devices 314, 316 prevent, or at least hinder, the withdrawal of coins from the coin chute. In particular, the anti-fishing devices 314, 316 prevent or hinder the withdrawal of coins that may be resting in the coin chute above the anti-pull back device 328. The anti-fishing devices 314, 316 are located within the coin channel 318 so that they impede withdrawal of coins. As depicted in FIG. 3, there are two anti-fishing devices with one device 316 located at least slightly below a lower edge of the coin chute entrance 304 and towards the side of the coin chute where the coin entrance 304 is located. The other one of the anti-fishing devices 314 is located on the side of the coin chute away from the coin chute entrance 304 and may be located at a slightly higher location within the coin chute than the other anti-fishing device 316.

Figure 5:
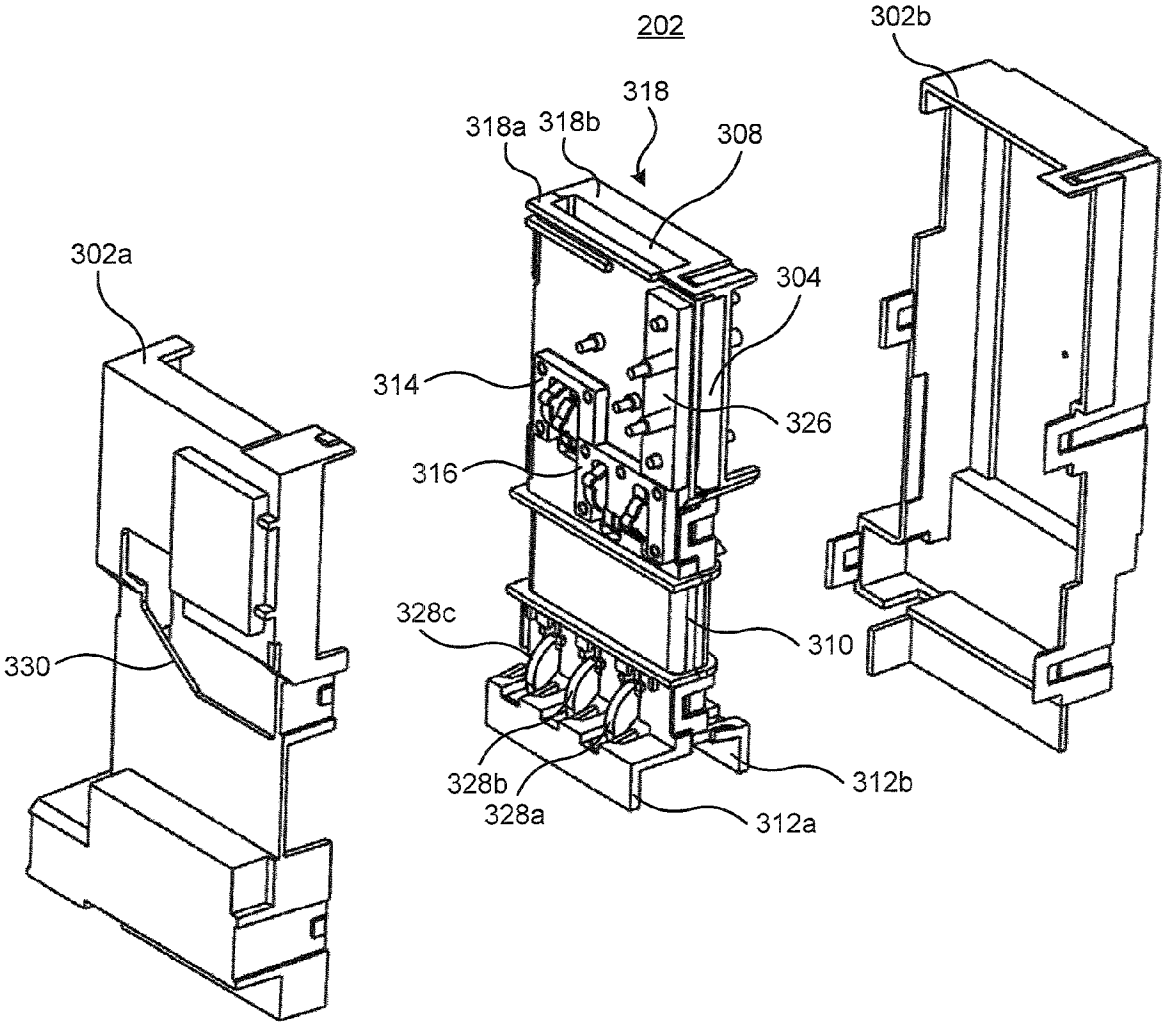
FIG. 5 depicts a partially exploded view of the coin chute of FIG. 3.

The anti-fishing devices 314, 316 may include a plurality of spaced apart rotatable fingers. The fingers may be constructed or assembled in a manner similar to or the same as the manner in which fingers for known anti-pull back devices are constructed or assembled. For example, the fingers of anti-fishing devices 314, 316 may rotate into the coin channel under the force of gravity, or some other slight biasing means. In order to allow the fingers to rotate freely within the coin channel, the outer housing 302*a* of the coin chute may include a cut out portion 330 to allow the fingers to rotate. When a coin is inserted into the coin channel, the coin passes down the coin channel and the force of the coin rotates the fingers out of the coin channel. Once the coin passes the anti-fishing devices, the fingers rotate back into the coin channel to prevent any coins that may be at rest in the coin channel from being pulled up or withdrawn past the anti-fishing devices and out of the coin channel. The anti-fishing devices 314, 316 reduce the volume of space within the coin channel in which coins may be at rest. For example, the anti-fishing devices 314, 316 reduce the available volume of space within the coin channel that may be available for accumulating and withdrawing coins due to a jam, or obstruction in the coin channel. This is because coins accumulated below or downstream of the anti-fishing devices due to jams or obstructions located below or downstream of the anti-fishing devices 314, 316 are not available for withdrawal as a result of the operation of the anti-fishing devices 314, 316. Preferably, and as shown in FIG. 5, the locating of the anti-fishing device 316 at or just below the bottom of coin chute entrance 304, and the anti-fishing device 314 across and above from the anti-fishing device 316, provides anti-fishing coverage across the width of the coin channel 318. Further, such an arrangement reduces or at least somewhat minimizes the volume in the coin channel within which coins can rest in the event of a blockage within the coin channel. As such, the number of coins that could potentially be fished out is reduced. Moreover, because such an arrangement includes anti-fishing device components at least somewhat below the bottom of the coin chute entrance 304, defeating or circumventing the anti-fishing devices 314, 316 is more difficult than in an implementation where the devices are located in a higher and/or more visible or accessible location in the coin chute.

Figure 6:
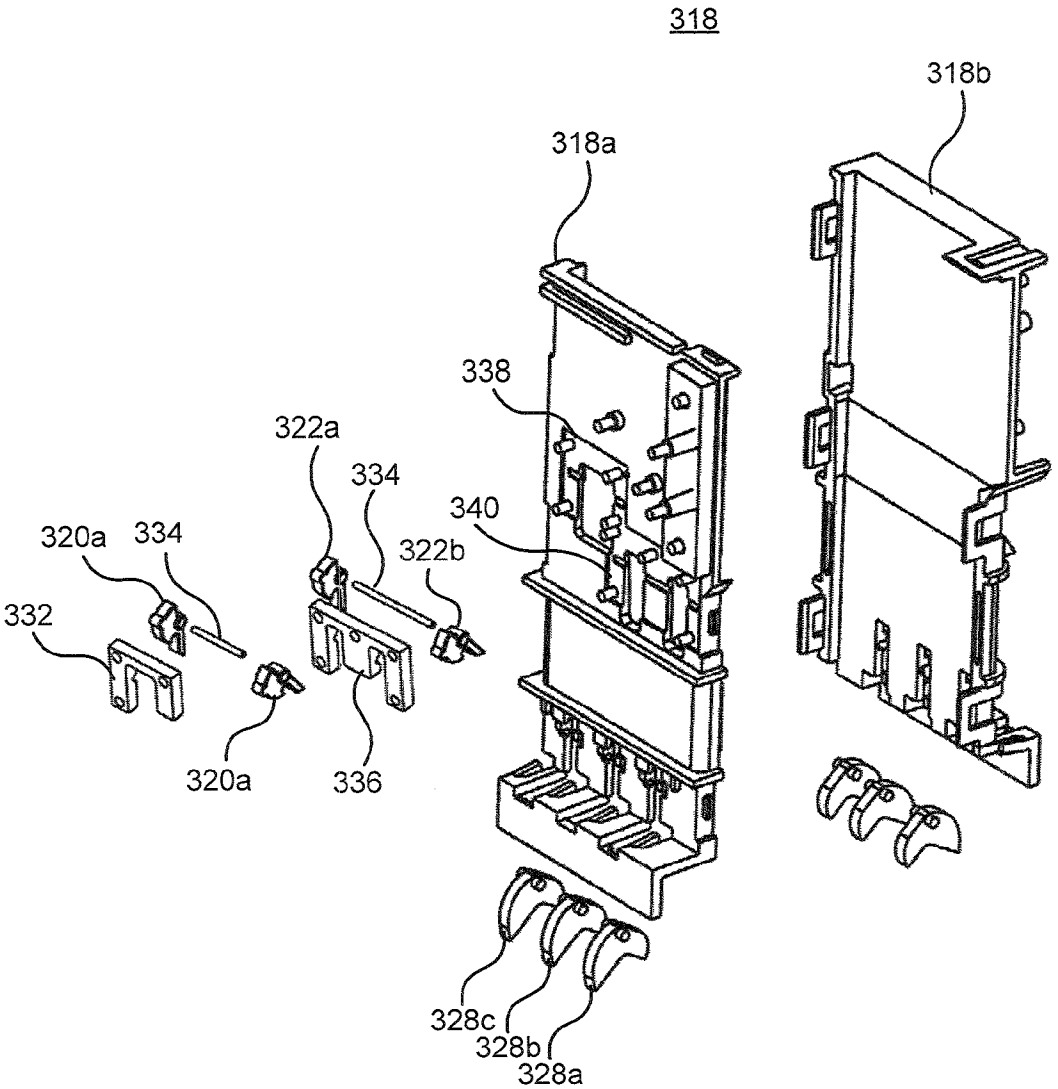
FIG. 6 depicts an exploded view of the coin channel of the coin chute of FIGS. 3 and 5.
Figure 7:
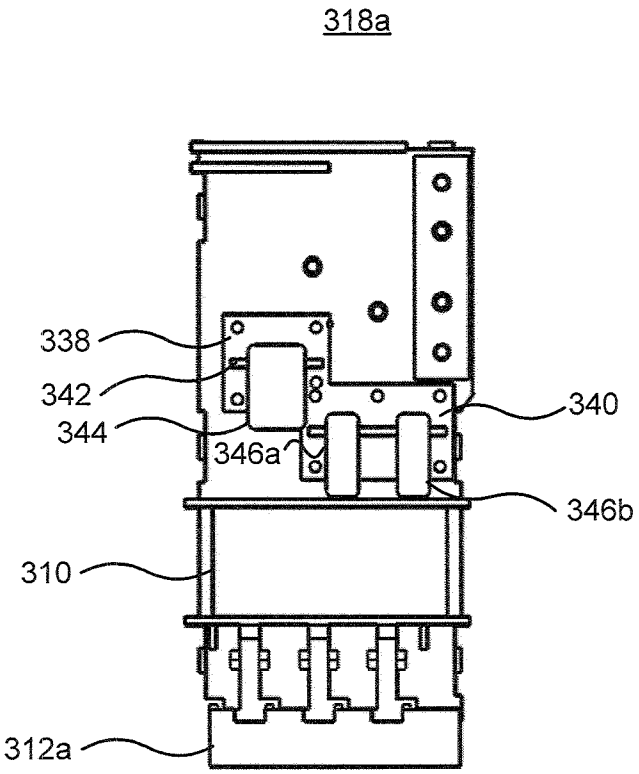
FIG. 7 depicts a side view of the wall of the coin channel wall of the coin chute of FIGS. 3, 5 and 6.

As depicted in FIG. 6, the anti-fishing devices 314, 316 may comprise a frame 332, 336 that each allow anti-fishing fingers to be rotatably mounted at the coin channel. The frames 332, 336 allow anti-fishing fingers 320*a*, 320*b*, 322*a*, 322*b* to be mounted to the coin channel wall 318*a*. As depicted, the coin channel wall 318*a* may include one or more locations, depicted as recesses 338, 340, for mounting the anti-fishing devices 314, 316. The spacing between the fingers 320*a*, 320*b* and 322*a*, 322*b* may vary between the different anti-fishing devices 314, 316. For example, the spacing between fingers 320*a*, 320*b* of anti-fishing device 314 may be less than the spacing between fingers 322*a*, 322*b* of anti-fishing device 316. The recess 338 may include an opening 344 through which the fingers may protrude into the coin channel. The recess may also include a further indentation or recess 342 for securely fitting the rod or axle used for rotatably connecting the fingers 320*a*, 320*b* to the coin channel wall 318*a*. The frame 332 may be secured to the wall 318*a* thereby securing the rod and fingers in place. The second frame 336 may similarly secure the fingers 322*a*, 322*b* to the coin channel wall 318*a* by securing the frame 336 within the recess 340. As noted above, the frame 336 may provide a wider spacing between the fingers 322*a*, 322*b* as compared to the spacing between fingers 320*a*, 320*b*. Similarly, the recess 340 may include two separate openings 346*a*, 346*b* through which the fingers 322*a*, 322*b* may respectively protrude into the coin channel. Varying the spacing of the fingers in this regard facilitates providing anti-fishing coverage across the width of the coin channel, and reducing or at least somewhat minimizing the volume in the coin channel within which coins can rest in the event of a blockage within the coin channel.

As discussed above and depicted in the Figures, the anti-fishing device 316, which is located on the side of the coin channel that is towards the coin entrance (as opposed to away from the coin entrance as is the case with anti-fishing device 314), may have a wider spacing between its fingers in order to impede fishing of larger sized coins. The anti-fishing device 314 may have narrower spacing between its fingers and may be located further up the coin channel relative to anti-fishing device 316. The narrower spacing of the fingers may be useful in preventing the withdrawal of smaller sized coins.

Figure 8:
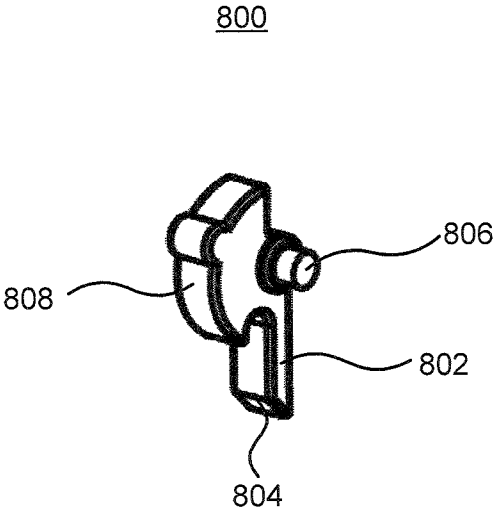
FIG. 8 depicts an alternative anti-fishing finger.

FIG. 8 depicts an alternative anti-fishing finger. As described above, anti-fishing fingers may be rotatably connected to the coin chute on a rod or axle. The fingers comprise a hole through which the rod or axle may be inserted. Alternatively, as depicted in FIG. 8, the anti-fishing fingers 800 may be formed as a single component that includes a protruding finger portion 802 that includes an end 804 that protrudes into the coin channel. The anti-fishing finger 800 may include rod-like protrusions that form pivot point 806 and allow the finger 800 to rotate when loosely secured to the coin channel wall. While the above embodiment depicted the anti-fishing fingers as being secured to the coin channel through a frame, it is possible that the anti-fishing fingers, including anti-fishing fingers such as finger 800, may be secured in other manners. For example, the anti-fishing assembly may comprise the anti-fishing finger 800 and a protrusion or other similar structure formed with, or attached to, the channel wall. The protrusion, or other similar structure, may engage the anti-fishing finger in order to rotatably secure the finger to the channel wall.

The anti-fishing finger 800, as well as the anti-fishing fingers described above, may include a counter weight portion 808 on the opposite side of the pivot point 806. The counter weight portion 808 may provide sufficient weight to rotate downward and cause the end of the finger 804 to rotate into the coin channel. The counter weight portion 808 is light enough so that the anti-fishing finger may be rotated out of the coin channel under the weight of a falling coin.

Preferably, the fingers of the present description are coloured black or a dark colour so that a person peering into a coin channel would have greater difficulty identifying or locating any fingers than if the fingers were of a bright or light colour. Minimizing the visibility of the fingers to potential vandals and thieves is preferred.

In order to further minimize the amount of theft of coins by vandals or thieves that may engage in fishing activities with respect to coin chutes, an insert or filler piece/object (not shown in the Figures) may be inserted into the coin channel such that the insert or filler object occupies a space extending from the entrance to the coin channel to the anti-fishing devices, either in whole or in part. The purpose of the insert or filler object is to restrict or narrow the width of the coin channel. By narrowing the width of the coin channel to, for example, accommodate the width of only one high value coin, the ability to fish coins is impeded, as the insert or filler prevents multiple coins from accumulating side-by-side in the coin channel.

A coin chute incorporating an anti-fishing device, as well as a parking meter incorporating a coin chute with an anti-fishing device, have been described by way of examples. It will be appreciated that components of one example may be incorporated into another example. Furthermore, although specific embodiments of a coin chute are described, it will be appreciated that anti-fishing fingers may incorporated into coin chutes of different designs. Variations and modifications not described herein will be apparent to one of ordinary skill in the art having regard to the description herein.

What is claimed is:

1. A coin chute for use in a vending machine comprising:

a coin channel defined by a first sidewall and a second sidewall opposite the first sidewall, the channel having a first portion through which coins may be inserted into the coin chute, and a second portion through which coins exit the channel;

a coin discriminator for determining a denomination of coin passing the discriminator; and a first anti-fishing assembly located between the first portion of the channel and the coin discriminator comprising an anti-fishing finger rotatable between a first position in which the anti-fishing finger extends across the channel to prevent coins that have not passed the coin discriminator from being retracted from the coin channel and a second position in which the anti-fishing finger is rotated out of the channel to allow coins to pass the coin discriminator.

2. The coin chute of claim 1, wherein the first sidewall and second sidewall are connected to each other by one or more of:

a snap-fit;

an adhesive; and mechanical fasteners.

3. The coin chute of claim 1, wherein the coin channel comprises a third portion at an end of the channel opposite the second portion, and wherein said third portion comprises an opening for at least partially inspecting the coin channel.

4. The coin chute of claim 1, wherein the anti-fishing finger of the first anti-fishing assembly is coloured black or is a dark colour.

5. The coin chute of claim 1, wherein the anti-fishing finger of the first anti-fishing assembly is not visible or is of reduced or limited visibility to a person at least horizontally peering into the coin chute at the first portion.

6. The coin chute of claim 1, further comprising a housing at least partially surrounding at least the coin channel, coin discriminator and first anti-fishing assembly.

7. The coin chute of claim 6, wherein the housing comprises a cut-out to allow rotation of the anti-fishing finger of the first anti-fishing assembly.

8. A vending machine comprising:

components for metering the sale of goods or services; and a coin chute according to claim 1 for receiving coins for purchasing the goods or services.

9. The vending machine of claim 8, wherein the goods or services metered comprises parking time for a parking space.

10. The coin chute of claim 1, further comprising:

an anti-pull back assembly located between the second portion of the channel and the coin discriminator comprising an anti-pull back finger rotatable between a first position in which the anti-pull back finger extends across the channel and a second position in which the anti-pull back finger is rotated out of the channel, wherein the anti-pull back finger is biased to the first position.

11. The coin chute of claim 10, wherein the anti-pull back assembly comprises a plurality of rotatable anti-pull back fingers.

12. The coin chute of claim 11, wherein at least one of the plurality of anti-pull back fingers is connected to the first sidewall and at least one of the plurality of anti-pull back fingers is connected to the second sidewall.

13. The coin chute of claim 1, wherein the coin channel comprises an insert or filler that restricts or narrows the width of the coin channel.

14. The coin chute of claim 13, wherein the coin channel is restricted or narrowed such that the coin channel is only able to accommodate the width of one high value coin.

15. The coin chute of claim 13, wherein at least in part the insert or filler occupies a space extending from the first portion to the first anti-fishing device.

16. The coin chute of claim 1, further comprising a second anti-fishing assembly located between the first portion of the channel and the coin discriminator comprising a rotatable anti-fishing finger.

17. The coin chute of claim 16, wherein the first anti-fishing assembly and the second anti-fishing assembly are offset vertically from each other in the channel.

18. The coin chute of claim 16, wherein the first anti-fishing assembly and the second anti-fishing assembly are both located on a same one of the first or second sidewalls.

19. The coin chute of claim 16, wherein the first anti-fishing assembly and the second anti-fishing assembly are located on different ones of the first or second sidewalls.

20. The coin chute of claim 16, wherein first anti-fishing assembly is located adjacent and immediately below the first portion of the channel through which coins may be inserted.

21. The coin chute of claim 20, wherein the second anti-fishing assembly is located on an opposite side of the channel from the first portion of the channel through which coins may be inserted and at least partially above the first anti-fishing assembly.

22. The coin chute of claim 16, wherein the first anti-fishing assembly and the second anti-fishing assembly are offset horizontally from each other in the channel.

23. The coin chute of claim 22, wherein the first anti-fishing assembly and the second anti-fishing assembly are offset vertically from each other in the channel.

24. The coin chute of claim 23, wherein the first anti-fishing assembly comprises a plurality of independently rotatable anti-fishing fingers spaced apart from each other by a first amount, and the second anti-fishing assembly comprises a plurality of independently rotatable anti-fishing fingers spaced apart from each other by a second amount different from the first amount.

25. The coin chute of claim 23, wherein first anti-fishing assembly is located adjacent and immediately below the first portion of the channel through which coins may be inserted, and the second anti-fishing assembly is located on an opposite side of the channel from the first portion of the channel through which coins may be inserted and at least partially above the first anti-fishing assembly.

26. The coin chute of claim 16, wherein the second anti-fishing assembly comprises a plurality anti-fishing fingers.

27. The coin chute of claim 26, wherein each of the plurality of anti-fishing fingers of the second anti-fishing assembly are independently rotatable.

28. The coin chute of claim 26, wherein the plurality of anti-fishing fingers of the second anti-fishing assembly are coloured black or are a dark colour.

29. The coin chute of claim 26, wherein the plurality of anti-fishing fingers of the second anti-fishing assembly are not visible or are of reduced or limited visibility to a person at least horizontally peering into the coin chute at the first portion.

30. The coin chute of claim 16, wherein the first anti-fishing assembly comprises a plurality of independently rotatable anti-fishing fingers spaced apart from each other by a first amount, and the second anti-fishing assembly comprises a plurality of independently rotatable anti-fishing fingers spaced apart from each other by a second amount different from the first amount.

31. The coin chute of claim 30, wherein each of the first anti-fishing assembly and the second anti-fishing assembly comprise an assembly frame securable to a coin chute frame, an axle secured between the assembly frame and the coin chute frame, wherein respective anti-fishing fingers are rotatably connected to the axle.

32. The coin chute of claim 31, wherein the first anti-fishing assembly and the second anti-fishing assembly are received within corresponding recesses within one of the first or second sidewalls.

33. The coin chute of claim 30, wherein the plurality of anti-fishing fingers of the first anti-fishing assembly and the plurality of anti-fishing fingers of the second anti-fishing assembly are coloured black or are a dark colour.

34. The coin chute of claim 30, wherein the plurality of anti-fishing fingers of the first anti-fishing assembly and the plurality of anti-fishing fingers of the second anti-fishing assembly are not visible or are of reduced or limited visibility to a person at least horizontally peering into the coin chute at the first portion.

* * * * *